US007283772B2

(12) United States Patent
Amano et al.

(10) Patent No.: US 7,283,772 B2
(45) Date of Patent: Oct. 16, 2007

(54) TONER SUPPLYING DEVICE, TONER SUPPLYING PROCESS, IMAGE FORMING APPARATUS, AND IMAGE FORMING PROCESS

(75) Inventors: Hirosato Amano, Numazu (JP); Masaki Serizawa, Numazu (JP); Makoto Hanada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 239 days.

(21) Appl. No.: 11/098,705

(22) Filed: Apr. 5, 2005

(65) Prior Publication Data

US 2005/0244193 A1 Nov. 3, 2005

(30) Foreign Application Priority Data

Apr. 5, 2004 (JP) ..... 2004-111044
Jun. 30, 2004 (JP) ..... 2004-194965
Jun. 30, 2004 (JP) ..... 2004-194966

(51) Int. Cl.
*G03G 15/08* (2006.01)

(52) U.S. Cl. ..... 399/258; 399/261

(58) Field of Classification Search ..... 399/258, 399/222, 238, 261

See application file for complete search history.

(56) References Cited

U.S. PATENT DOCUMENTS 4,023,527 A * 5/1977 DeMayo ..... 399/261
4,833,501 A * 5/1989 Buyukguclu ..... 399/261
4,945,956 A 8/1990 Bueyuekgueclue et al.
5,722,018 A * 2/1998 Hart et al. ..... 399/258
5,727,607 A * 3/1998 Ichikawa et al.
5,915,154 A 6/1999 Schoch et al.
5,950,055 A 9/1999 Yahata et al.
6,311,745 B1 * 11/2001 Welch et al.
6,505,022 B2 * 1/2003 Kosuge et al. ..... 399/258
6,608,983 B2 * 8/2003 Terazawa et al. ..... 399/258
6,854,493 B2 * 2/2005 Ichikawa et al.

(Continued)

FOREIGN PATENT DOCUMENTS

JP 11237790 A * 8/1999

(Continued)

OTHER PUBLICATIONS

U.S. Appl. No. 11/679,949, filed Feb. 28, 2007, Sano et al.

(Continued)

*Primary Examiner*—Susan Lee
(74) *Attorney, Agent, or Firm*—Oblon, Spivak, McClelland, Maier & Neustadt, P.C.

(57) ABSTRACT

The present invention provides toner supplying devices, toner supplying processes, and the like that control bulk density of a mixture of toner and gas efficiently thereby enhancing the fluidity of the mixture, and maintaining the high fluidity for a long period. The invention includes a toner supplying device that has a toner containing portion configured to store a toner, a toner outlet configured to discharge the toner from the toner containing portion, a conveying pipe configured to convey the toner, and a gas feeding unit configured to feed a gas. The toner supplying device supplies the toner from the toner containing portion to an image forming unit of an image forming apparatus. A porous member is disposed near the toner outlet, and the gas is fed into the toner containing portion through the porous member.

40 Claims, 16 Drawing Sheets

U.S. PATENT DOCUMENTS

| | | | | |
|---|---|---|---|---|
| 6,859,634 | B2 | 2/2005 | Itoh et al. | |
| 6,863,096 | B2 | 3/2005 | Amano | |
| 6,874,546 | B2 | 4/2005 | Amano et al. | |
| 2002/0106221 | A1* | 8/2002 | Muramatsu et al. | 399/258 |
| 2003/0053826 | A1 | 3/2003 | Bares et al. | |
| 2003/0170049 | A1* | 9/2003 | Itoh et al. | 399/258 |
| 2004/0009015 | A1* | 1/2004 | Fujimori et al. | 399/258 |
| 2005/0244193 | A1 | 11/2005 | Amano et al. | |

FOREIGN PATENT DOCUMENTS

| | | | |
|---|---|---|---|
| JP | 2000-238311 | | 9/2000 |
| JP | 2001117371 | A * | 4/2001 |
| JP | 2003-330218 | | 11/2003 |
| JP | 2004-4394 | | 1/2004 |
| WO | WO 2004/083038 | A1 | 9/2004 |

OTHER PUBLICATIONS

U.S. Appl. No. 11/679,964, filed Feb. 28, 2007, Sano et al.
U.S. Appl. No. 11/683,656, filed Mar. 8, 2007, Itoh et al.
U.S. Appl. No. 11/683,253, filed Mar. 7, 2007, Itoh et al.
U.S. Appl. No. 11/685,059, filed Mar. 12, 2007, Chiba et al.
U.S. Appl. No. 11/736,296, filed Apr. 17, 2007, Sano.

* cited by examiner

TONER SUPPLYING DEVICE, TONER SUPPLYING PROCESS, IMAGE FORMING APPARATUS, AND IMAGE FORMING PROCESS

BACKGROUND OF THE INVENTION

1. Field of the Invention

The present invention relates to toner supplying devices appropriately utilized for image forming apparatuses such as printers, facsimiles, copiers, hybrid apparatuses, in particular electrophotographic image forming apparatuses; and toner supplying processes, image forming apparatuses, and image forming process that utilize the toner supplying apparatuses respectively.

2. Description of the Related Art

Toner supplying devices are widely utilized in image forming apparatuses such as printers, facsimiles, and copiers in order to convey toner through conveying pipes usually equipped with a movable member such as a screw auger. In such toner supplying devices, there exist some problems that toner agglomerates generate due to toner softening derived from intense rubbing of toner between the movable member and the pipe wall, and dynamic properties of toner changes due to separation of external additives from toner surface, resulting in adverse effects on images. Recently, toner with lower softening temperatures is desired in order to reduce fixing temperatures as low as possible, which accelerating generation of toner agglomerates i.e. so-called secondary particles.

In order to solve such problems, Japanese Patent Application Laid-Open (JP-A) Nos. 2003-330218 and 2004-4394 propose a toner supplying device. In the toner supplying device, pressure generated by rotating a stator with uniaxial eccentric screw and double-start spiral holes is utilized to convey the mixture of toner and air without a coil screw, and the toner is supplied to the developing unit or the related storage tank from a separately disposed toner storage unit, toner supplying unit, or the like. Further, screw pumps or so-called mono pumps are known that are utilized to convey the mixture of toner and air by means of pressure generated in situ.

In such conveying devices, there exist some advantages that the conveying distance may be easily extended, the conveying devices are compacted, the configuration is simplified, and the maintenance is relatively easy. Specifically, as shown in FIG. 1, the conveying device is equipped with screw pump 211 such as a mono pump that conveys a mixture of air and toner, toner container 212, nozzle 213 that is disposed at bottom of the toner container 212 and act to suck the toner, air pump 218, aperture 214 that connects to the air pump 218, conveying pipe 215, and filter 219. Air is intermittently directed from air pump 218 through aperture 214 into toner container 212, thereby a mixture of air and toner is formed, and the fluidized toner is directed to the toner outlet and conveying pipe 215. The mixture of toner and air directed into the conveying pipe 215 is further directed to developing unit 216 by the sucking action of mono pump.

Such toner conveying devices provide advantages that the toner may be easily conveyed to the developing unit or the related storage container due to the higher fluidity of the mixture of air and toner, and the residue of toner may be reduced in the toner container.

However, such toner conveying devices suffer from a problem that the air fed into the toner container cannot satisfactorily break secondary toner particles in the toner container. Namely, the air fed near the nozzle forms larger bubbles in the mass of toner within the toner container; the bubbles move and/or burst in the mass of toner and thus the mixture of air and toner is formed, which exhibits relatively high fluidity; however, the secondary toner particles that have been present prior to the air feeing hardly break by the air feeding into the toner container, consequently, the secondary toner particles tend to deteriorate image quality. This problem is serious with respect to nowadays highly fine and precise images since toners are required that have smaller particle sizes.

Further, another toner supplying device is proposed wherein a larger toner container is provided outside an image forming apparatus, and toner is supplied from a larger toner container to a developing unit of the image forming apparatus. However, the device also employs a screw pump similar to that of JP-A Nos. 2003-330218 and 2004-4394 described above; thus the toner supplying device suffers from similar problems described above.

Further, there exist image forming apparatuses of direct recording as shown in JP-A No. 2000-238311, in addition to those of electrophotography. In such image forming apparatuses, toner is applied as droplets onto recording media such as recording paper, thereby images are recorded directly. In such image forming apparatuses also, the friction of toner due to movable parts is undesirable and desired to eliminate, for example, by conveying the toner to an ink applying device by means of sucking unit such as a suction pump.

However, such a toner conveying device suffers from a problem that the air fed into the toner container cannot satisfactorily break secondary toner particles in the toner container as described above. Further, in the toner conveying device, the conveying line often clogs and the operation is disturbed when the image forming apparatus is stopped for a few days for example, which is resulted from solidification or blocking of toner within the conveying line.

Further, the mixture of toner and air formed by the toner conveying devices in the prior art may not exhibit sufficient fluidity when the conveying distance is longer or when the mixture is to be conveyed from lower site to higher site, which limits the design and/or layout of image forming apparatuses.

In addition, as for the reason of clogging within conveying lines, the toner flowing into the conveying pipe has various bulk densities depending on stirring conditions and residence times; the toner with higher bulk densities tends to clog within the conveying pipe.

In order to address such a problem, the image forming apparatus illustrated in JP-A Nos. 2003-330218 and 2004-4394 described above is equipped with a nozzle in a toner containing portion and a gas feeding unit such as a blower to feed gas into the nozzle periodically. The periodical stirring of the toner in the toner containing portion by gas may avoid excessive increase of the bulk density.

However, the lower bulk density is often no more than temporary; that is, the bulk density tends to increase rapidly under sucking action. Although not wishing to limit the present invention to any one theory, the reason is believed that when the toner is sucked out from the toner containing portion, the gas existing relatively apart from the toner is sucked in addition to the toner and the surrounding gas, and gas is sucked preferentially than the toner. When allowing to stand the toner a few days in a condition of higher bulk density within conveying pipes for example, larger blocks of toner are likely to yield, resulting in clogging of the conveying pipes.

Further, frequent air blows from nozzles has been tried in order to prevent the clogging within the conveying lines. However, frequent air blows cannot successfully prevent the clogging in most cases. Although not wishing to limit the present invention to any one theory, the reason is believed that the gas blown from nozzles does not necessarily spread into the toner containing portion uniformly, nonuniform zones inevitably exist. Consequently, toner with higher bulk densities flows into conveying lines, and when allowing to stand the toner a few days, larger blocks of the toner are likely to yield, resulting in clogging of the conveying pipe.

As such, toner supplying devices and the related technologies are demanded still that may control the bulk density of the mixture of toner and gas more efficiently thereby the fluidity of the mixture is enhanced, the fluidity may be maintained uniformly within toner conveying lines even when toner resides for a long period, higher image quality may be obtained even under prolonged usage of image forming apparatuses, and toner may be conveyed smoothly at the staring operation even after longer stoppage.

SUMMARY OF THE INVENTION

Accordingly, the object of the present invention is to provide toner supplying devices, toner supplying processes, image forming apparatuses, and image forming processes that may control the bulk density of the mixture of toner and gas more efficiently thereby the fluidity of the mixture is enhanced, the fluidity may be maintained uniformly within toner conveying lines even when toner resides for a long period, higher image quality may be obtained even under prolonged usage of image forming apparatuses, and toner may be conveyed smoothly at the staring operation even after longer stoppage.

In one aspect, the present invention provides a toner supplying device that comprises a toner containing portion configured to store a toner, a toner outlet configured to discharge the toner from the toner containing portion, a conveying pipe configured to convey the toner, and a gas feeding unit configured to feed a gas, wherein the toner supplying device supplies the toner from the toner containing portion to an image forming unit of an image forming apparatus, a porous member is disposed near the toner outlet, and the gas is fed into the toner containing portion through the porous member.

In another aspect, the present invention provides a toner supplying process that comprises flowing the toner into a conveying pipe, and conveying the toner through the conveying pipe, wherein the toner is conveyed from the toner containing portion to an image forming unit of an image forming apparatus, and a gas is fed through a porous member disposed near a toner outlet of the toner containing portion into the toner containing portion.

In still another aspect, the present invention provides an image forming apparatus that comprises an electrostatic latent image bearing member, an electrostatic latent image forming unit configured to form an electrostatic latent image on the electrostatic latent image bearing member, an image forming unit configured to develop a toner image by means of a toner, a toner supplying unit configured to supply the toner, a transferring unit configured to transfer the toner image onto a recording medium, and a fixing unit configured to fix the transferred image on the recording medium, wherein the toner supplying unit comprises a toner containing portion configured to store a toner, a toner outlet configured to discharge the toner from the toner containing portion, a conveying pipe configured to convey the toner, and a gas feeding unit configured to feed a gas, and wherein the toner supplying device supplies the toner from the toner containing portion to an image forming unit of an image forming apparatus, a porous member is disposed near the toner outlet, and the gas is fed into the toner containing portion through the porous member.

In still another aspect, the present invention provides an image forming process that comprises forming an electrostatic latent image on an electrostatic latent image bearing member, developing a toner image by means of a toner, supplying the toner for developing the toner image from a toner containing portion, transferring the toner image onto a recording medium, and fixing the transferred image on the recording medium, wherein the supplying of the toner is performed by means of a toner conveying unit that comprises a toner containing portion configured to store a toner, a toner outlet configured to discharge the toner from the toner containing portion, a conveying pipe configured to convey the toner, and a gas feeding unit configured to feed a gas, and wherein the toner supplying device supplies the toner from the toner containing portion to an image forming unit of an image forming apparatus, a porous member is disposed near the toner outlet, and the gas is fed into the toner containing portion through the porous member.

In accordance with the present invention, a porous member is disposed near the toner outlet, and a gas is fed into the toner containing portion through the porous member. Namely, the gas is injected through porous material rather than from a larger aperture such as of pipe, therefore, the gas can be introduced in finely dispersed condition and from larger injecting area into the toner containing portion. Consequently, a mixture of the toner and the gas having a bulk density of 0.2 to 0.3 g/cm$^3$ can yield stably and uniformly even immediately after the gas is injected. On the contrary, in the case of a nozzle having a larger aperture, the mixture of toner and gas usually exhibits a bulk density of 0.2 to 0.5 g/cm$^3$ and the bulk density is unstable with time and ununiform throughout the mass of toner.

Such lower and uniform bulk density of the mixture of toner and gas may lead to higher fluidity, which allows stable and efficient image formation processes and also higher and stable image quality.

Further, such higher fluidity may allow transportation of the mixture of the toner and the gas by use of pressure from lower site to higher site, which affords various margin with respect to design and/or layout of image forming apparatuses.

Figure 1:
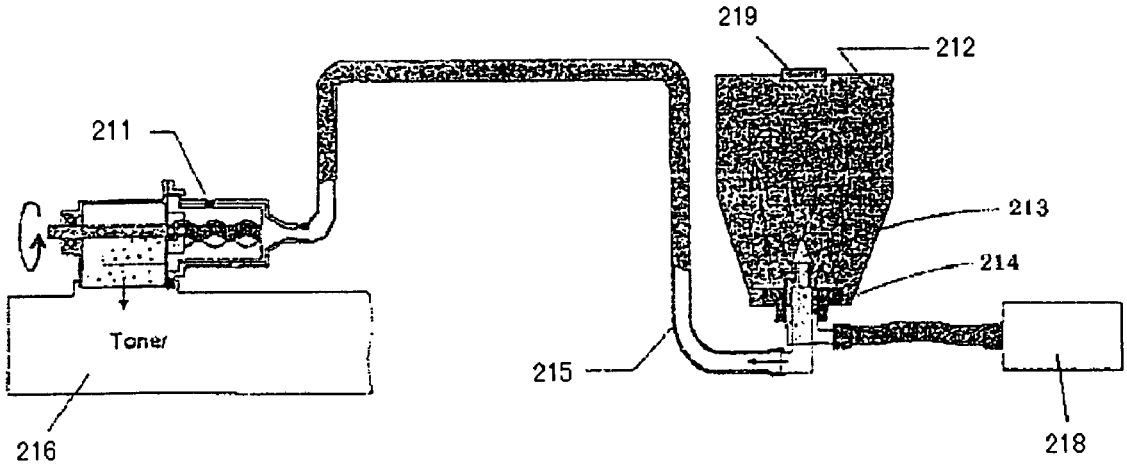
(PRIOR ART) FIG. 1
FIG. 1 is a schematic view that shows an exemplary toner conveying device in the prior art.

DESCRIPTION OF THE PREFERRED EMBODIMENTS (Toner Supplying Device and Toner Supplying Process)

The toner supplying device according to the present invention comprises a toner containing portion configured to store a toner, a toner outlet configured to discharge the toner from the toner containing portion, a conveying pipe configured to convey the toner, a gas feeding unit configured to feed a gas, and other parts such as a vibrating device depending on the requirements.

The toner supplying process according to the present invention comprises flowing the toner into a conveying pipe, conveying the toner through the conveying pipe, and other steps such as vibrating depending on the requirements.

The toner supplying process according to the present invention may be carried out using the toner supplying device according to the present invention.

The gas employed in the gas feeding unit and fed into the toner containing portion may be employed depending on the application; preferably the gas is air; in addition, when the toner should be processed under inert or less active atmosphere, nitrogen gas, argon gas and the like are preferable, for example.

Preferably, the toner containing portion comprises a converging zone where the size of the side wall gradually decreases toward and near the toner outlet, and the porous member is disposed on at least one of the side wall of converging zone and the vicinity of the toner outlet; and one of the traverse section, the width, and the diameter of the converging zone gradually decreases toward and near the toner outlet at the converging zone.

Such shapes of the converging zone may be selected from the reversed shapes of circular cone, elliptic cone, and polygon pyramid such as triangular pyramid, and quadrangular pyramid, for example.

By the way, the width and the diameter described above means the average of the longest width or diameter and the shortest width or diameter in the traverse section when the traverse section is not square or circular.

Preferably, the porous member holds pores capable of passing through gas, and the average size of the pores is 0.1 to 5 times the volume average particle size of the toner; and the average pore size of the porous member is 0.3 to 20 μm; the toner containing portion is a toner container equipped with the toner outlet; and the porous member exists near the toner outlet of the toner container.

The porous material may be properly selected from commercially available materials such as sintered metals, porous ceramics, porous resins and the like; in addition, the porous material may be multi layered metal mesh.

Preferably, a filter is provided which passes the gas within the toner containing portion and prevents passing through of the toner.

Preferably, a vibrating device is provided which is configured to vibrate the toner within the toner containing portion; the vibrating device is a sonic vibrator which contacts with outer surface of the toner containing portion; or the vibrating device is a hammer vibrator which contacts with outer surface of the toner containing portion; or the vibrating device is a unit configured to repeatedly contact with outer surface of the toner containing portion to vibrate the toner containing portion.

Preferably, the vibrating device is activated after the toner container is mounted to the image forming apparatus; the vibrating device is activated prior to activating the gas feeding unit; the vibrating device is disposed at tapered portion of the converging zone of the toner containing portion; and the toner containing portion have a thinner wall thickness at the area where the vibrating device contacts with than the other area.

These vibrating devices perform to promote the mixing of toner and gas, thereby enhancing the fluidity of the mixture.

Preferably, the toner outlet comprises a hole into which a toner discharging unit in the shape of nozzle is detachably inserted, and the mixture of the toner and the gas is discharged through the toner discharging unit; and a toner concentration sensor is provided near the toner outlet.

Preferably, the toner in the toner containing portion is supplied to a developing device which develops a latent image formed on an electrostatic latent image bearing member; and the conveying pipe comprises a toner outlet, the conveying pipe is disposed at the bottom of the toner containing portion, and the toner outlet is opened within the toner containing portion.

Preferably, a porous member is provided on the way of the conveying pipe, and the gas is fed into the toner containing portion through the porous member also; the conveying pipe is a flexible conveying hose; a sucking unit is provided which is configured to feed toner into an image forming apparatus while sucking the toner existing within the conveying pipe; and a sucking control unit is provided which is configured to control the action of the sucking unit, and the sucking unit is activated intermittently such that the sucking control unit control the start and stop repeatedly.

Preferably, a lower limit detector is provided which is configured to detect the lower level of toner in the toner containing portion, and the sucking control unit controls the sucking unit depending on the lower limit detector; an evacuating unit is provided which is configured to evacuate the gas within the toner containing portion; and an evacuation control unit is provided which is configured to control the evacuating rate of the evacuating unit.

Preferably, an upper limit detector is provided which is configured to detect a predetermined upper level of toner in the toner containing portion, and an alarm generator is provided which is configured to generate an alarm depending on the upper limit detector.

(Image Forming Apparatus and Image Forming Process)

The image forming apparatus according to the present invention comprises an electrostatic latent image bearing member, an electrostatic latent image forming unit, an image forming unit, a toner supplying unit, a transferring unit, a fixing unit configured, and other units such as a charge removing unit, cleaning unit, recycling unit, controlling unit and the like depending on requirements.

The toner supplying unit in the image forming apparatus may be the toner supplying device according to the present invention.

The image forming process according to the present invention comprises forming an electrostatic latent image, developing a toner image, supplying the toner for developing the toner image, transferring the toner image, fixing the transferred image, and other processing such as charge removing, cleaning, recycling, controlling and the like depending on requirements.

The supplying of the toner may be performed by the toner supplying device according to the present invention, and the image forming process according to the present invention may be performed by the image forming apparatus according to the present invention.

Preferably, the toner supplying unit is disposed inside the image forming apparatus; alternatively, the toner supplying unit is disposed outside the image forming apparatus.

Preferably, an open-close shutter is provided at a toner receiving inlet of the image forming unit which is configured to receive the toner conveyed by the toner supplying unit. The open-close shutter may be constructed using a gate valve, butterfly valve, rotary valve, needle valve or the like.

Preferably, the conveying pipe is reversibly separable into two pipes, and one pipe is supported by a first support which also supports the image forming unit, the other pipe is supported by a second support which also supports the toner containing portion and the gas feeding unit; a sucking unit is supported by the first support; the toner conveying unit is movable by means of at least a caster; the toner is sent from the toner conveying unit to a toner storage section within the image forming unit where the toner is stored temporarily; and the toner containing portion is detachably attached to the second support.

Electrostatic Latent Image Forming

The electrostatic latent image forming is one that forms an electrostatic latent image on the electrostatic latent image bearing member or photoconductor. The electrostatic latent image may be formed, for example, by uniformly charging the surface of the electrostatic latent image bearing member, and irradiating it imagewise. The latent image forming unit, for example, comprises a charger that uniformly charges the surface of the latent image bearing member, and a light irradiator which exposes the surface of the latent image carrier imagewise.

The charging may be performed, for example, by applying a voltage to the surface of the latent image bearing member using the charger.

Examples of the charger include contact chargers such as conductive or semi-conductive roller, brush, film or rubber blade, and non-contact chargers using corona discharge such as corotron and scorotron.

—Image Forming—

The image forming is performed by using the toner as the developer to form a visible image. In the image forming apparatus, the toner and a carrier may be mixed and stirred together, for example. The toner is then charged, and forms a magnetic brush on the surface of the rotating magnet roller. Since this magnet roller is arranged near the latent image bearing member or photoconductor, a part of toner in the magnetic brush formed on the surface of the magnet roller moves to the surface of the latent image bearing member due to the force of electrical attraction. As a result, the latent image is developed by toner, and a toner image is formed on the surface of the latent image bearing member.

—Transferring—

In the transferring, the visible image is transferred to a recording medium. The primary transfer is performed such as, using the intermediate transferring belt as an intermediate transferring body, the visible image is primarily transferred to the intermediate transferring belt; and the second transfer is then performed wherein this visible image is secondarily transferred to a recording medium. Preferably, using toner of two or more colors, more preferably using full color toner, the primary transfer step transfers the visible image to the intermediate transferring belt to form duplicated transfer images, and the second transfer step transfers the duplicated images to the recording medium.

—Fixing—

In the fixing, the visible image transferred to the recording medium is fixed. The fixing may be carried out for developer of each color transferred to the recording medium, or in one operation when the developers of each color have been laminated.

The fixing unit may be suitably selected from conventional heat and pressure units. Examples of heat and pressure unit are a combination of a heat roller and pressure roller, and a combination of a heat roller, pressure roller, and endless belt.

As for the other units or processing, charge removing from the latent image bearing member may be properly carried out by means of a discharge lamp, for example; cleaning the toner remaining on the latent image bearing member may be performed by a magnetic brush cleaner, electrostatic brush cleaner, magnetic roller cleaner, for example.

EXAMPLE 1

The present invention will be explained with respect to a tandem color-laser printer (hereinafter, referring to as "exemplified printer"), which is an image forming apparatus equipped with the toner supplying device according to the present invention.

Figure 2:
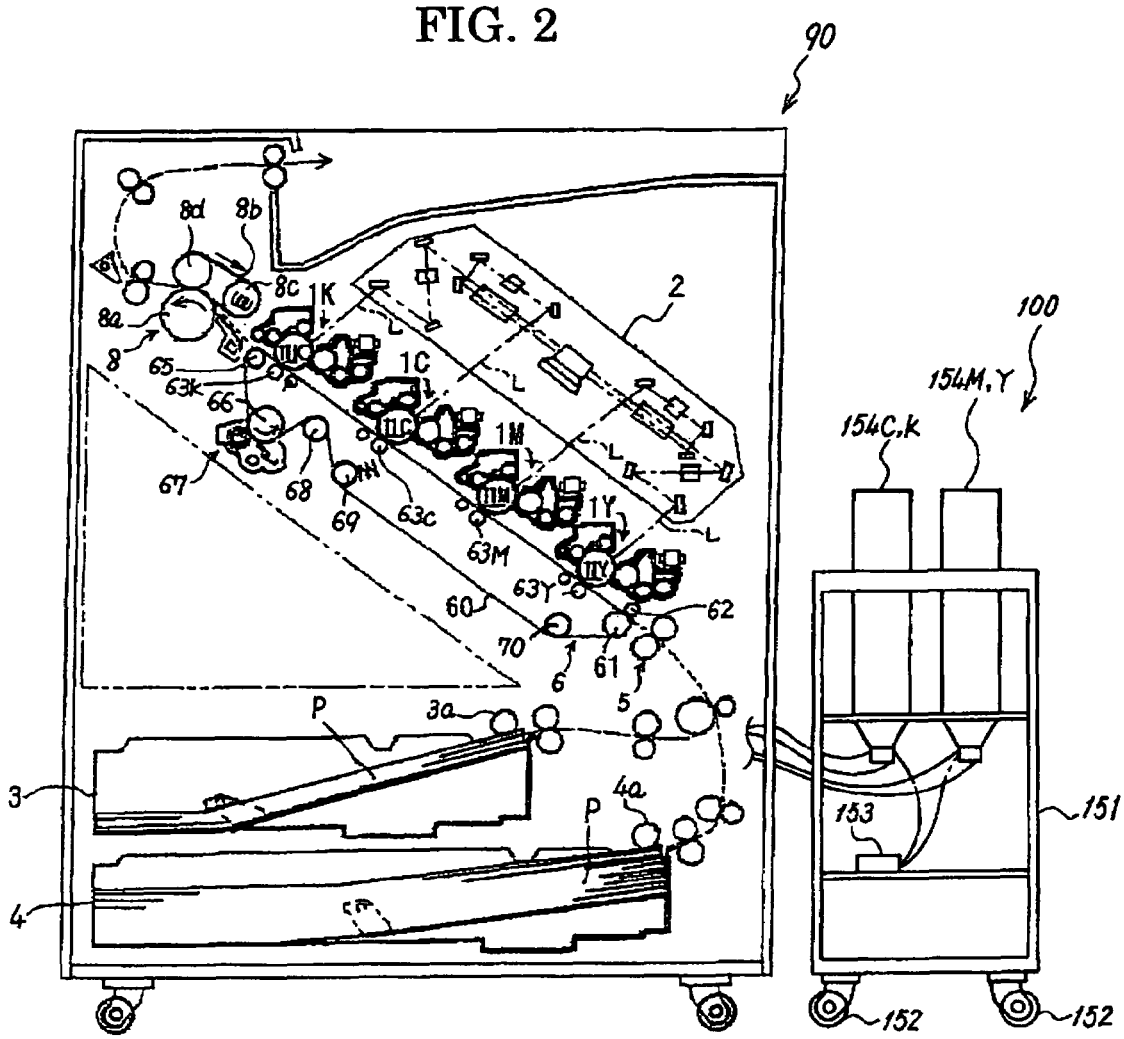
FIG. 2 is a schematic view that shows an exemplary construction of an image forming apparatus according to the present invention.

FIG. 2 is a schematic view that exemplarily shows a printer construction of an image forming apparatus according to the present invention. The exemplified printer is equipped with printing section 90 and toner storage section 100, which are movable independently.

The printing section 90 is equipped with four image recording portions 1Y, 1M, 1C, and 1K to form four images of yellow (Y), magenta (M), cyan (C), and black (B) respectively. Further, printing section 90 is equipped with light-writing unit 2, paper-feeding cassettes 3 and 4, resist roller pair 5, transferring unit 6, fixing unit 8 of belt fixing, and paper-discharging tray. In addition, a manual feeding tray, toner-supplying container, exhausted toner bottle, and electrical power supply (not shown respectively) are installed to printing section 90.

Image recording portions 1Y, 1M, 1C, and 1K are respectively equipped with drum photoconductors 11Y, 11M, 11C, and 11K each of which is an electrostatic latent image bearing member. Each of the photoconductors 11Y, 11M, 11C, and 11K is driven to rotate clockwise in FIG. 2 by a driving portion (not shown) thereby to expose the surface endlessly, and bears electrostatic latent images of yellow, magenta, cyan, and black by laser scanning of light-writing unit 2 that irradiates laser beam L modulated based on image information from a computer (not shown) and the like.

Figure 3:
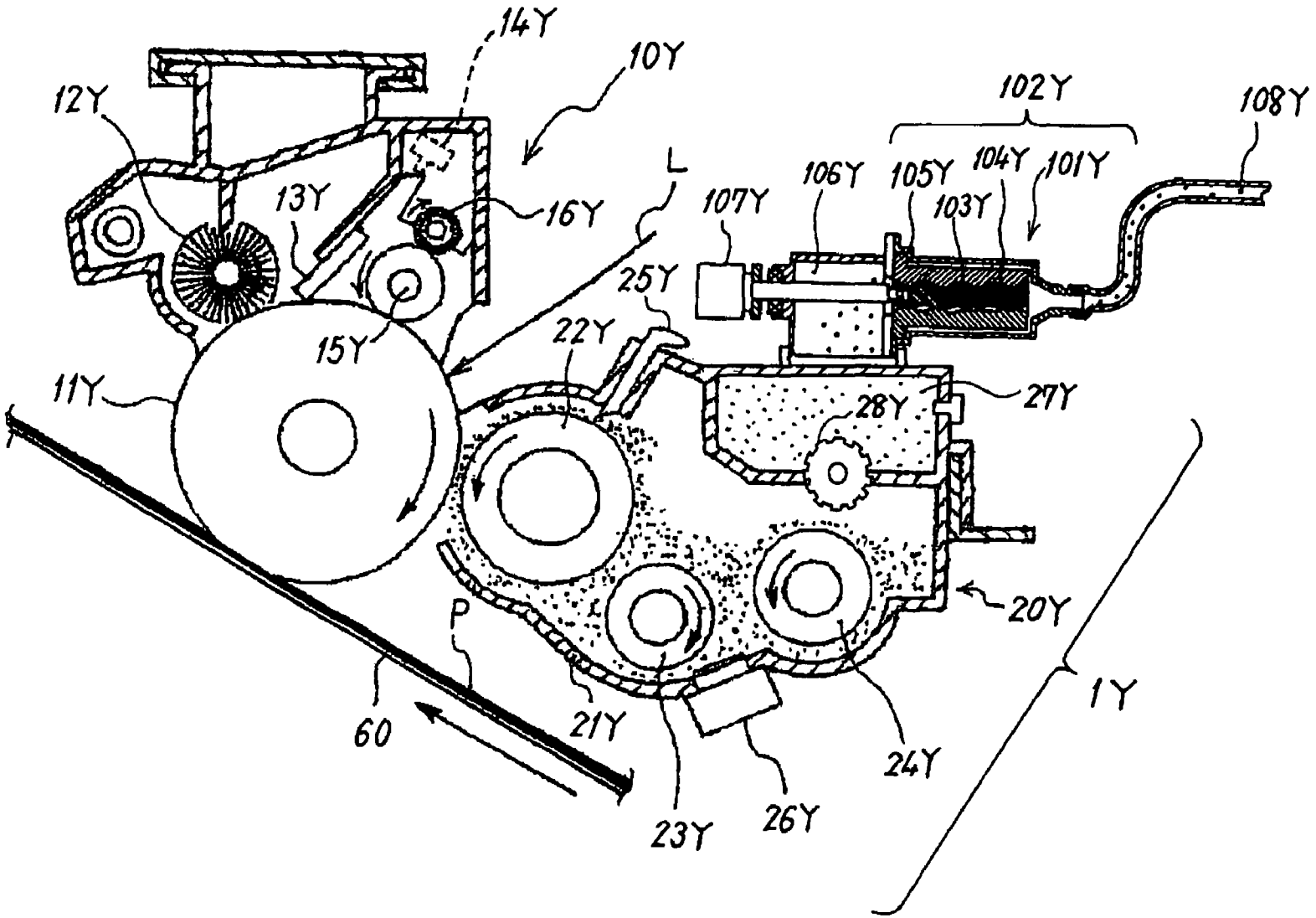
FIG. 3 is a schematic section view that shows a yellow image recording portion and a partial transferring unit.

FIG. 3 is a schematic sectional view that shows yellow image recording portion 1Y and partial transferring unit 6. The construction of image recording portions 1M, 1C, and 1K are the same with that of image recording portion 1Y except for image color. In FIG. 3, image recording portion 1Y is equipped with process unit 10Y and developing unit 20Y. Process unit 10Y is equipped with photoconductor 11Y, brush roller 12Y to coat a lubricant on the surface, counter blade 13Y capable of shaking for cleaning, charge removing lamp 14Y for eliminating charge, charging roller 15Y for charging uniformly the photoconductor 11Y, and roller cleaning device 16Y for cleaning roller surface.

In the process unit 10Y explained above, charging roller 15Y to which alternative charging bias is applied by a power supply (not shown) is arranged to contact with photoconductor 11Y, and the charging roller 15Y charges uniformly the surface of photoconductor 11Y at the contacting area while being rotated in the reverse direction with photoconductor 11Y by a driving unit (not shown). When laser beam L modulated and polarized by the light writing unit (2 in FIG. 2) is scanned on the uniformly charged surface of photoconductor 11Y, an electrostatic latent image is formed on the surface.

Developing unit 20Y of the image recording portion is equipped with developing roll 22Y that is exposed from the aperture of developing case 21Y, first conveying screw 23Y, second conveying screw 24Y, developing doctor 25Y, toner concentration sensor 26Y, toner storage portion 27Y and the like.

In developing case 21Y, a developer is stored that contains a magnetic carrier and a minus-chargeable yellow toner. The developer is subjected to friction charging while being mixed and conveyed by the first conveying screw 23Y and the second conveying screw 24Y, then is carried on the surface of developing roll 22Y as a developer bearing member. Then, the layer thickness of the developer is defined by the developing doctor 25Y, the developer is transported to the developing area opposite to photoconductor 11Y, the yellow toner is deposited over the electrostatic latent image on photoconductor 11Y. The deposition forms a yellow toner image on photoconductor 11Y. The developer returns into developing case 21Y by way of rotation of developing roll 22Y after being partially consumed by the developing. On the other hand, the developed toner image is transferred onto transferring paper P that is conveyed by paper conveying belt 60. The developing roll 22Y is equipped with a developing sleeve of a magnetic pipe that is driven to rotate by a driving unit (not shown), and a magnetic roller disposed inside the magnetic pipe freely from the rotating movement of the developing sleeve. The developer is carried on the surface of the developing sleeve through attracting the developer on the surface of developing sleeve by magnetic power from the magnetic roller.

The toner concentration sensor 26Y of a magnetic permeability sensor, which is attached at the bottom plate of developing case 21Y, outputs voltages of which the value depends on the magnetic permeability of the developer being conveyed by the first conveying screw 23Y. The magnetic permeability of the developer exhibits a relevant correlation with the toner concentration in the developer, thus the toner concentration sensor 26Y can output a voltage depending on the yellow toner concentration. The output voltage is informed to a controlling portion (not shown). The controlling portion is equipped with a memory unit such as RAM, in which memorized are an output voltage target from toner concentration sensor 26Y and output voltage targets from other toner concentration sensors mounted to other developing devices.

As for the developing device 20Y, difference of two values is calculated between the output voltage from toner concentration sensor 26Y and the target output voltage, then supplying roller 28Y disposed within toner storage portion 27Y is rotated for the period depending on the difference, thereby the yellow toner stored within toner storage portion 27Y is supplied into developing device 20Y. Namely, the movement of supplying roller 28Y is controlled for toner supplying, the yellow toner is supplied in an amount appropriate to compensate the yellow toner of reduced concentration due to developing, thus the yellow toner concentration in the developer is maintained within a proper range in developing unit 20Y. Similar control for toner supplying is performed with respect to the other developing units. In addition, toner concentration sensor 29Y is disposed in toner storage portion 27Y for detecting toner at a pre-determined height.

As explained above, image recording portions 1Y, 1M, 1C, and 1K as shown in FIG. 2 cooperate respectively with light-writing unit 2 to form images on the respective photoconductors 11Y, 11M, 11C, and 11K. As such, the exemplified printer above performs as an image forming unit that forms toner images on an endlessly moving surface of photoconductors 11Y, 11M, 11C, and 11K by combining image recording portions 1Y, 1M, 1C, and 1K and light-writing unit 2.

Two paper feeding cassettes 3, 4 are disposed at lower portion of printer 90. Transferring papers P are piled within the paper feeding cassettes 3, 4; the upper most transferring paper P is urged to contact with paper feeding rollers 3*a*, 4*a*. The transferring papers are fed into a paper feeding line by rotating paper feeding rollers 3*a*, 4*a* in a pre-determined timing. At the end of the paper feeding line, resist roller pair 5 is disposed, which sends the fed transferring paper to transferring unit 6 so as to synchronizes with the yellow toner image formed on photoconductor 11Y of image recording portion 1Y.

Transferring unit 6 is equipped with paper conveying belt 60, inlet roller 61, electrostatic roller 62, four bias rollers 63Y, 63M, 63C, and 63K, four supporting rollers 64Y, 64M, 64C, and 64K, and separating roller 65; and also driving roller 66, belt-cleaning unit 67, contacting roller 68, tension roller 69, lower roller 70, and the like.

The paper conveying belt 60 is rotated anti-clockwise in FIG. 3, while being tensioned by plural rollers, by driving roller 66 that is rotated anti-clockwise in FIG. 3.

As shown in FIG. 2, inlet roller 61, bias rollers 63Y to 63K, supporting rollers 64Y to 64K, separating roller 65, driving roller 66, tension roller 69, and lower roller 70 respectively contact with the backside of paper conveying belt 60 or inner side of the loop. The inlet roller 61 disposed most right in FIG. 2 holds paper conveying belt 60 between electrostatic roller 62. A bias voltage is applied to electrostatic roller 62; when a charge is applied to the front face of belt or the outer surface of loop, transferring paper P fed through the resist roller pair 5 are sucked electrostatically.

Four bias rollers 63Y to 63K are made of core metal and surrounding elastic material such as rubber or foam, and are pressed toward four photoconductors 11Y to 11K respectively, thereby holding paper conveying belt 60. Due to the pressing, transferring nips are formed where photoconductors 11Y, 11M, 11C, and 11K and paper transferring belt 60 contact along certain distance in belt moving direction. To the core metals of bias rollers 63Y, 63M, 63C, and 63K, transferring bias is applied that is controlled constant by the transferring bias supply. The transferring bias provides a transferring charge to the backside of paper conveying belt 60 through transferring bias rollers 63Y, 63M, 63C, and 63K, thereby transferring electric field is formed at the respective transferring nips between paper transferring belt 60 and photoconductors 11Y, 11M, 11C, and 11K. Although transferring bias rollers 63Y, 63M, 63C, and 63K are installed as the transferring bias member in the printer, the rollers may be exchanged into a bias member of brush, blade, or the like.

The transferring paper sent from resist roller pair 5 into the transferring unit is held between electrostatic roller 62 and paper conveying belt 60, and passes through the transferring nips for yellow, magenta, cyan, and black sequentially while being sucked at the front face of paper conveying belt 60. In such process, yellow, magenta, cyan, and black toner images are duplicated on the transferring paper P at the respective transferring nips, and are superimposed and transferred on the transferring paper P under the effects of electric field and nip pressure. The superimposed transfers may yield a full color image on transferring paper P.

The transferring paper P, on which a full color image is formed, reaches to the site tensioned by separating roller 65 while the paper conveying belt 60 rotates endlessly. At the site tensioned by separating roller 65, separating roller 65 tensions paper conveying belt 60 in a condition that paper conveying belt 60 nearly traverses the traveling direction. The transferring paper P sucked on the paper transferring belt 60 cannot follow the rapid change of belt traveling direction, resulting in separating from paper conveying belt 60 and entering into fixing unit 8.

The tension roller 69 is urged toward paper conveying belt 60 by a spring, thereby providing paper conveying belt 60 with a predetermined tension. Pushing roller 68 pushes the front surface of the tensioned belt between tension roller 69 and driving roller 67. The pushing provides the paper conveying belt with a large depression between tension roller 69 and driving roller 67. Such a large depression of the paper conveying belt 60 assures the larger area of paper conveying belt 60 winding over driving roller 67. Belt cleaning device 67 contacts with the front surface of the winding area. Dust toner from photoconductors 11Y, 11M, 11C, and 11K adheres on the front surface of paper conveying belt 60 after transferring paper is fed to the fixing unit at the site tensioned by the separating roller 65. Belt cleaning device 67 removes the dust toner from paper conveying belt 60.

Fixing unit 8 is equipped with pressing roller 8*a*, endless fixing belt 8*b*, heating roller 8*c*, driving roller 8*d* and the like. The fixing belt 8*b* is tensioned by heating roller 8*c* and driving roller 8*d*, and travels endlessly clockwise in FIG. 2 by action of driving roller 8*d* that is driven to rotate by a driving unit (not shown). The heating roller 8*c* installs a heat source such as a halogen lamp, and heats the paper conveying belt 8*b* from backside thereof. On the other hand, pressure roller 8*a* contacts with fixing belt 8*b* that travels endlessly, and forms a fixing nip at the contacting site. The transferring paper P, fed to fixing unit 8 from paper transferring belt 60, is hold between the fixing nip while the image transferred surface being contacted with fixing belt 8*b*, and passes through the fixing unit 8 while a full color image being fixed by way of heating and pressing.

The transferring paper P, following the fixing unit 8, passes through a conveying roller pair, reversible guide plate, and another conveying roller pair; and outputs into the stack portion provided at upper side of the housing.

In FIG. 3, after transferring paper P passes through the transferring nip, the surface of photoconductor 11Y is coated with an amount of lubricant by means of brush roller 12Y, then is cleaned by means of counter blade 13Y and is charge-removed by means of irradiation from charge removing lamp for the next image forming.

Small amount of toner may inevitably remain on the surface of photoconductor after cleaning by counter blade 13Y. The toner remained after the cleaning is removed by means of roller cleaning device 16Y.

As shown in FIG. 3, suction pump 101Y is detachably connected to toner storage portion 27Y of developing device 20Y within image recording portion 1Y. The suction pump, which constitutes a part of toner conveying device, is classified into a uniaxial eccentric screw pump i.e. so-called mono pump. The pumping portion 102Y is constructed from rotor 103Y formed of metal or stiff resin worked into an eccentric double-start screw structure, stator 104Y formed of rubber etc. with a double-start screw cavity, and holder 105Y formed of resin that encases them. Suction pump 101Y is equipped with discharging portion 106Y, motor 107Y to rotate rotor 103Y etc. in addition to pumping portion 102Y.

When rotor 103Y of double-start screw rotates within stator 104Y, minus pressure generates at the suction side of pumping portion 102Y (right side in FIG. 3). Due to the minus pressure, the yellow toner in the toner containing portion is sucked through conveying pipe or hose 108Y, then reaches to pumping portion 102Y of suction pump 101Y, flows within stator 104, and outputs into discharging portion 106. The outputted yellow toner is supplied into toner storage portion 27Y of developing device 20Y connected to discharging portion 106. The other toners of magenta, cyan, and black are similarly supplied. In the exemplified printer, four devices for supplying toner are constructed from four suction pumps, connecting hoses, four toner storage portions, etc.

In FIG. 2, toner storage section 100 is equipped with trestle 151 formed of L-shape steel etc., four casters 152, blower 153, four toner containing portions 154Y, 154M, 154C, and 154K and the like.

As explained above, printer section 90 is supported separately from the respective toner containing portions 154Y, 154M, 154C, and 154K, and blower, in the exemplified printer. In such a construction, a large amount of toner can be stored and supplied without excessively enlarging the size of printer section 90. Consequently, whereas about 200 to 300 grams of toner was the upper limit to store in the toner containing portion in the previous manner, the construction described above makes possible to store ten times the amount of the previous toner containing portion.

Figure 4:
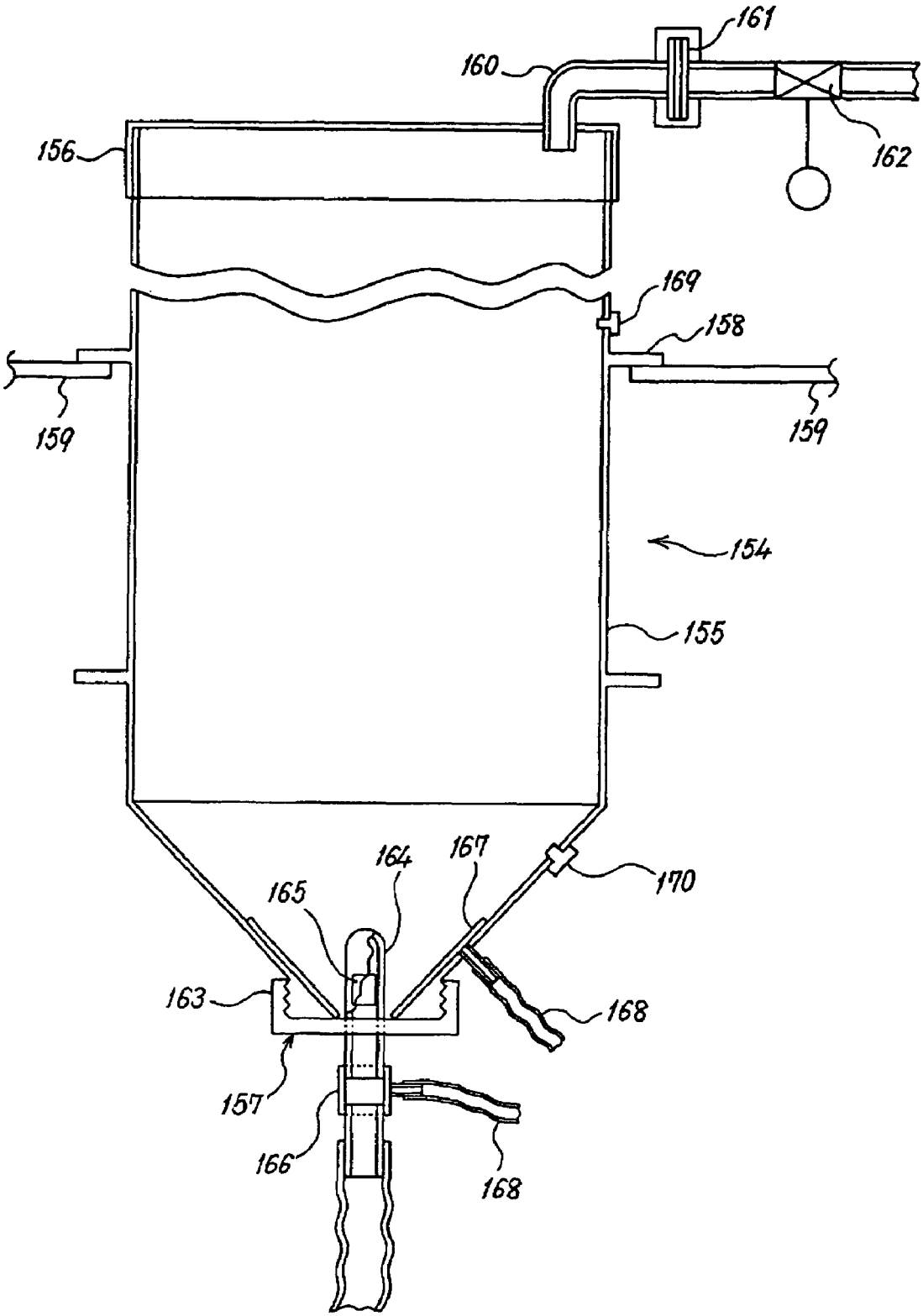
FIG. 4 is an enlarged view of the toner containing portion shown in FIG. 2.

FIG. 4 is an enlarged view of the toner containing portion shown in FIG. 2.

The toner containing portion 154 in FIG. 4 is constructed from container portion 155 that is formed of cylinder part and conical part, lid 156, cap 157 etc. At the middle of cylinder part of container portion 155, projection 158 is provided that project ring-wise from the outer surface. The toner containing portion 154 is set into a circular hole (not shown) provided in support plate 159 attached to trestle 151.

At the upper portion of cylinder part of container portion 155, upper limit sensor 169 is provided to detect the upper level of toner in the toner containing portion. Further, at the conical part of container portion 155, lower limit detecting sensor 169 is provided to detect the lower level of toner in the toner containing portion.

At the upper end of the container portion 155, lid 156 is mounted detachably. Toner can be manually supplied from the upper opening when the lid 156 is detached from the container portion. To the detachable lid 156, gas duct 160 is connected. To the gas duct 160, filter member 161 and gate valve 162 are connected as shown in FIG. 4.

Cap portion 157 comprises detachable cap member 163 that is engaged at lower end of container 155, and nozzle member 164 that is attached to provide a pipe line connecting inside and outside of the container portion 155.

Toner outlet 165 is provided at the upper end of nozzle member 164; and porous tube 166 is connected to the lower end of nozzle member 164 that is formed from porous material such as porous sintered glass as shown in FIG. 4. The porous material of the porous tube 166 may be sintered porous material of glasses, metals, and resins having an average particle size of approximately 10 μm that is smaller than the average particle size of toner.

At the tapered portion of the lower side of the container 155, porous member 167 formed of porous material such as sintered glass is disposed around the tapered portion to surround the toner outlet 165 as shown in FIG. 4. To the porous tube of nozzle 164 and porous member 167 of container 155, air tube 168 is connected respectively as shown in FIG. 4. The other end of the air tube 168 (not shown) is connected to blower 153 in FIG. 2. The air from the blower 153 is fed into container 155 and nozzle 164 through air tube 168, porous member 167, and porous tube 166.

Conveying pipe 108 is connected to the nozzle 164 at the outside of the container. The other end of the conveying hose 108 is connected to suction pump 101 with the printer section. When suction pump 101 is activated, the toner in toner containing portion is sucked out and supplied into toner storage portion 27 through conveying pipe 108, nozzle 164, and suction pump 101.

Figure 5:
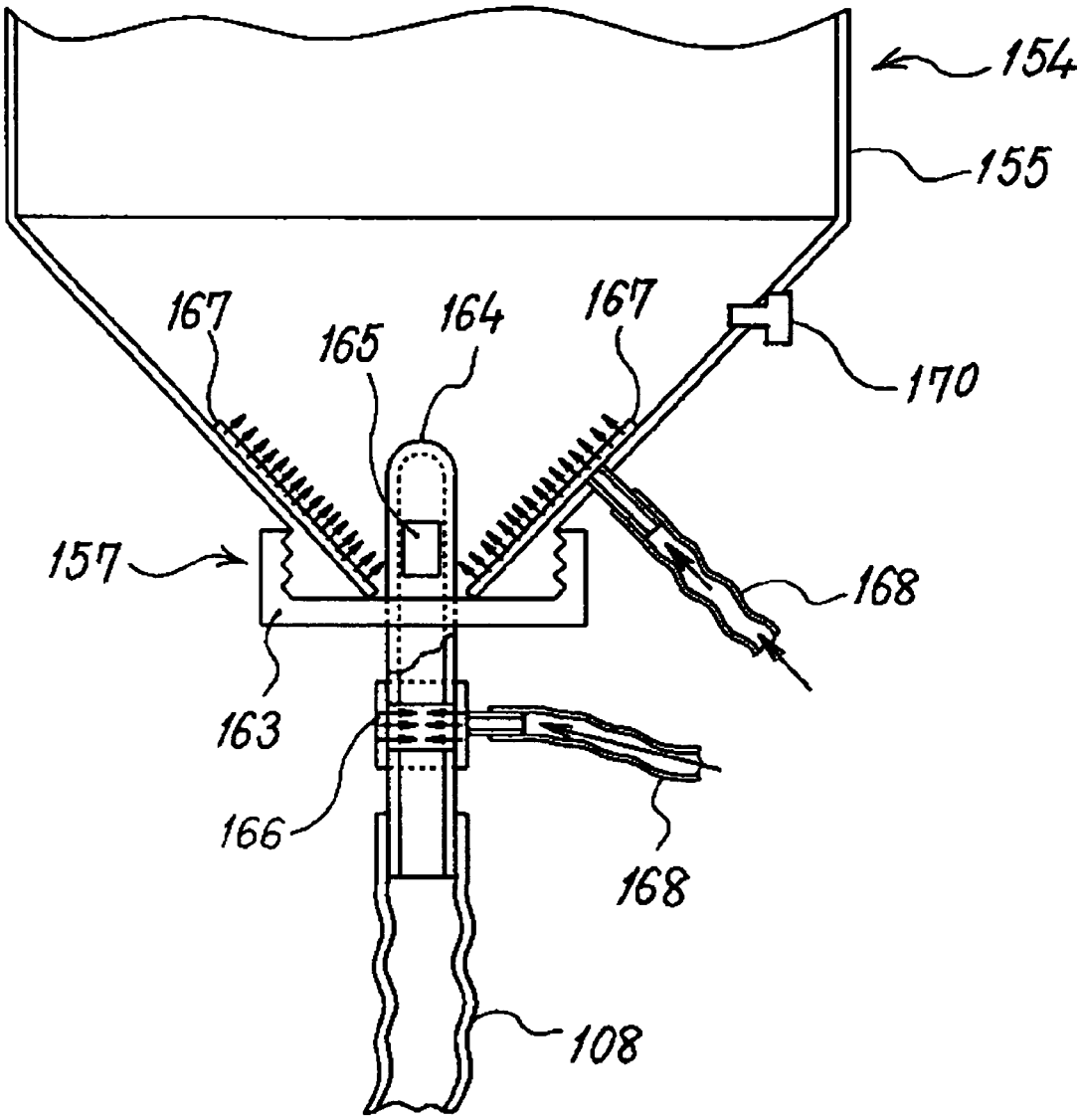
FIG. 5 is an enlarged section view of FIG. 4 that shows the lower part of container and the cap portion.

FIG. 5 is an enlarged section view of FIG. 4 that shows the lower part of container 155 and cap portion 157. The air fed to porous tube 166 and porous member 167 through air tube 168 flows and separates into numerous fine pores existing in porous tube 166 and porous member 167, then flows into the container, in a condition that numerous bubbles are ejected from the surface of porous tube 166 and porous member 167. By the way, a blower 153 in FIG. 2 is utilized for four toner containing portions in exemplified printer.

Figure 6:
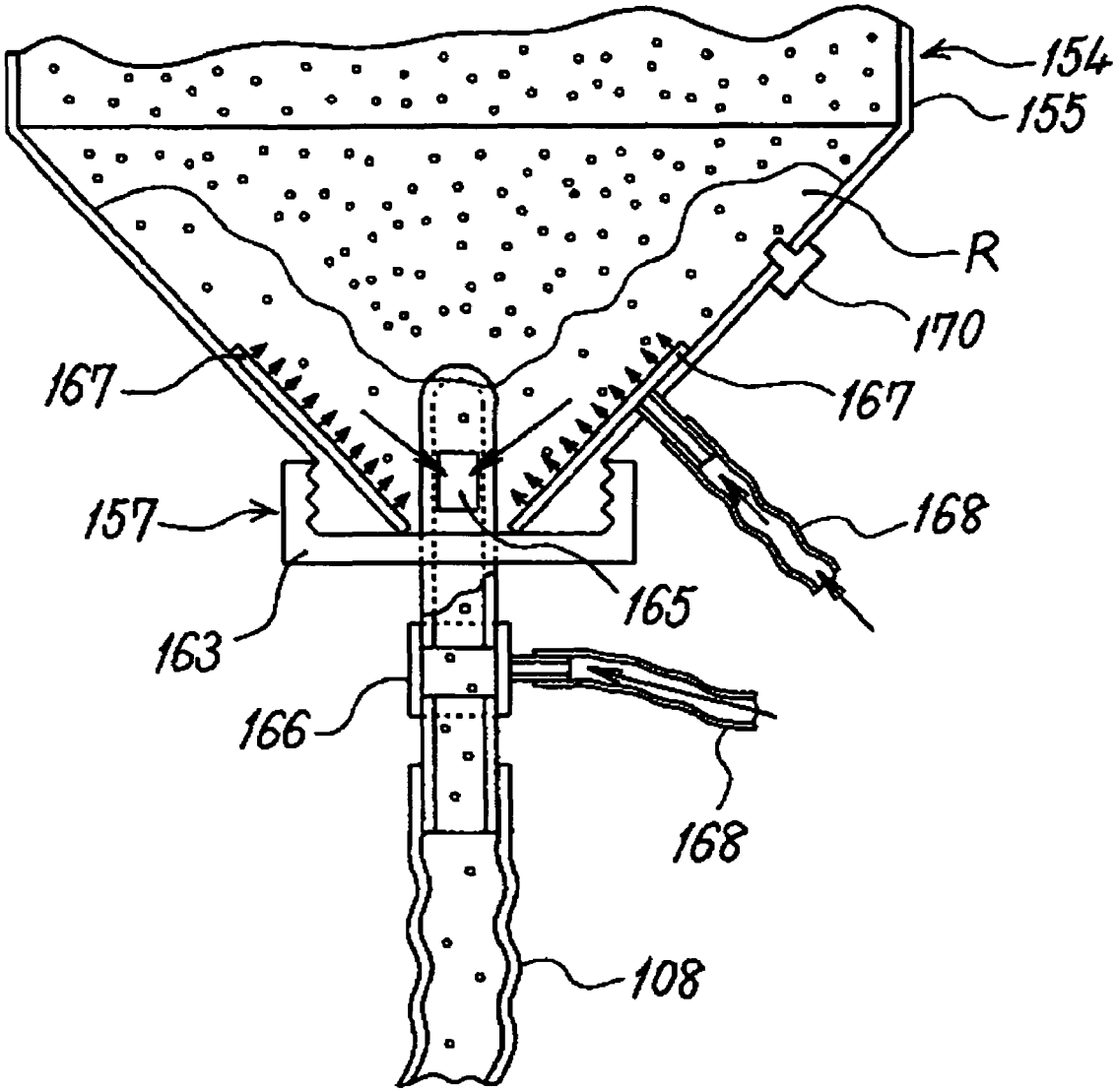
FIG. 6 is a schematic section view that shows a condition of toner at the lower part of container and the cap portion.

FIG. 6 is a schematic section view that shows a condition of toner at the lower part of container 155 and cap portion 157. When numerous air bubbles are ejected from the surface of porous member 167 in a certain flow rate, the toner in the container may be fluidized and generate a fluidized bed R within a certain height in the container. Toner moves actively in the fluidized bed R and toner above the certain height moves less actively with a bulk density lowered by the air from the fluidized bed R.

The fluidized bed R can exist around the toner outlet 165 entirely, since the porous member surrounds the nozzle member 164. Accordingly, toner with excessively higher density cannot flow into conveying pipe 108 by the way that toner is forced to flows into toner outlet 165 by means of sucking action while making the toner fluidized around the toner outlet 165, which bring about non-clogging of toner within the conveying pipe 108.

As shown in FIG. 6, the toner powder can display high fluidity like a liquid by way of fluidizing the toner and then feeding into nozzle 164 and conveying pipe 108. Accordingly, when toner is conveyed from higher site of toner containing portion 154 to lower site of image recording portion, the toner may be conveyed without power source e.g. a pump as liquids are conveyed from higher site to lower site. In the exemplified printer, a suction pump is provided since the toner is conveyed from lower site to higher site.

In addition, when toner is fluidized, the toner may be conveyed from lower site to higher site without suction pump 101 by way of pressurizing within the toner containing portion 154. When toner is outputted from toner containing portion 154 while making the toner fluidized, the conveying pipe equipped with a moving part is not necessary, which avoid the adverse effects on images derived from such a moving part.

Conveying pipes equipped with a moving part inevitably have a linear construction since a degree of stiffness is necessary. Such conveying pipes cannot be freely arranged the position in an apparatus, which reduces remarkably the margin to design layout. On the contrary, no conveying pipe equipped with a moving part is required in the exemplified printer, thus conveying pipe 108 may be employed that is flexible as shown in FIG. 6, which make possible to arrange the conveying pipe freely in the exemplified printer and significantly increases the margin to design the layout.

Preferably, the porous member 167 within toner containing portion 154 is disposed at the backside of cap member 163 or the adjacent backside of tapered portion, as shown in FIG. 6. Such arrangement may make possible to fluidize preferentially the toner of lower part in the toner containing portion 154, which also make possible to prevent the formation of toner agglomerates at the bottom of toner containing portion 154 due to prolonged deposition of toner.

In the exemplified printer, nozzle 164 is equipped with porous tube 166 as shown in FIG. 6, and blower 153 and air tube 168 send air to porous tube 166 as well as porous member 167 in the toner containing portion. In such construction, toner flows into nozzle member 164 while the toner being fluidized in toner containing portion 154, and also the fed toner is further fluidized by bubble blow from porous tube 166, thus the toner clogging may be prevented more surely in the conveying pipe.

When toner is conveyed from higher site to lower site without power source, or when toner is conveyed from lower site to higher site while pressurizing the toner containing portion 154, preferably, air blowing is performed in a condition that plural porous members are provided within the conveying line with a certain pitch between them. The reason is that in the case that toner is conveyed from higher site to lower site without power source, or in the case that toner is conveyed from lower site to higher site while pressurizing the toner containing portion 154, the conveying is optionally stopped depending on requirements by shutting the gate valve in the conveying line or stopping the pressurizing; as a result, the toner in the conveying line is obliged into a condition apart from fluidizing. Consequently, the re-conveying of toner is not necessarily easy in the conveying line when the conveying is to be started again. On the contrary, air blowing with a certain pitch within the conveying line may make the toner in the conveying line re-fluidized entirely when the conveying is started again.

Figure 7:
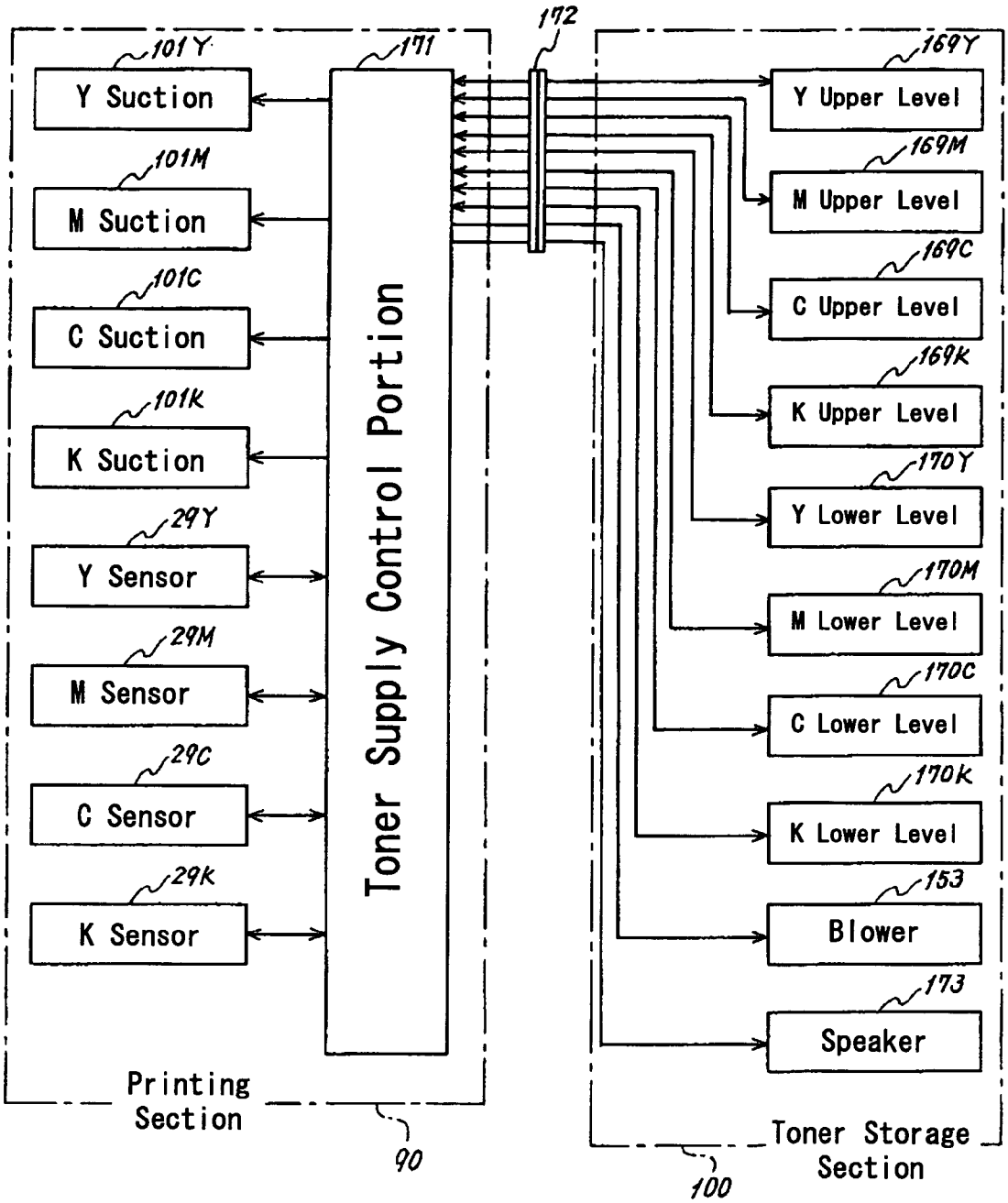
FIG. 7 is a block diagram that shows the electric circuit of the exemplified printer.

FIG. 7 is a block diagram that shows the electric circuit of the exemplified printer. In printer section 90, toner supply control portion 171 for four toner conveying devices is disposed in addition to suction pumps 101Y, 101M, 101C, and 101K. These suction pumps 101Y, 101M, 101C, and 101K, and toner concentration sensors 29Y, 29M, 29C, and 29K, provided at toner storage portions, are connected electrically to the toner supply control portion 171.

On the other hand, upper limit sensors 169Y, 169M, 169C, and 169K, and lower limit sensors 170Y, 170M, 170C, and 170K are arranged electrically for four toner containing portions in the toner storage section 100. Further, blower 153 and speaker 173 are also arranged. These are electrically connected to toner supply control portion 171 of printer section 90.

The toner supply control section 171 acts to drive blower 153 to fluidize toner in the respective toner containing portions 154 in a normal condition, and also acts to supply toner depending on the signals from toner concentration sensor provided at toner containing portions by driving the corresponding suction pump. Specifically, when yellow toner concentration sensor 29Y comes to send no signal in terms of yellow toner detecting, the amount of yellow toner comes to lower than a certain level in the yellow toner storage portion; then toner supply control portion 171 act to drive yellow suction pump 101Y for a predetermined period, which is conducted by repeating intermittently start and stop. The predetermined period is adjusted sufficiently long such that the amount of supplied toner is sufficient for the yellow toner concentration sensor can detect the yellow toner again. Accordingly, when the yellow suction pump 101Y stops the intermittent operation, toner concentration sensor 29Y comes to detect the yellow toner again.

However, when yellow toner concentration sensor 29Y sends no signal of yellow toner detecting, the toner supply control portion 100 does not control to operate intermittently provided that no lower level signal is sent from yellow lower level sensor 170Y. In addition, when lower level signal is sent from yellow lower level sensor 170Y, and when the signal is stopped during the intermittent operation, the intermittent operation is stopped immediately. Due to these controls, the operation of yellow suction pump 101Y can be avoided when the toner is empty in yellow toner containing portion 154Y.

As for the exemplified printer, toner can be supplied manually into toner storage portion if necessary. The manual supply is conducted by detaching the lid 156 from the container portion. The manual supply may bring about toner overflow due to excessively plenty pouring. In order to prevent such toner overflow, toner supply control portion 171 sends an alarm signal to speaker 173 when a signal of upper level is sent from any one of upper level sensors 169Y, 169M, 169C, and 169K, which generate an alarm sound from speaker 173. Thereby, the operator can notice the possibility to overflow the toner in operation. By the way, although the alarm generator is constructed by combining toner supply control portion 171 and speaker 173 in the exemplified printer, the other combination may be possible. For example, the combination of toner supply control portion 171 and a display may be possible when an alarm is generated by image display in place of alarm sound.

As shown in FIG. 4, gas duct 160 is fixed to lid 156 of toner containing portion 154, which allows the air in the toner containing portion 154 to flow out, thereby preventing the excessive pressure increase in toner containing portion due to the air feeding through porous member 167. However, the simple flow out of air may exhaust the toner accompanying with the air, therefore, filter 161 is provided on the way of gas duct 160 to trap the toner.

At the down stream of the filter 161, gate valve 162 is provided to control the exhaust gas flow. By controlling the flow rate of exhaust gas by means of gate valve 162, the toner discharge can be promoted from toner output 165 by maintaining the pressure inside the toner containing portion 154 at a level somewhat higher than atmospheric pressure during air is fed to porous member 167.

Figure 8:
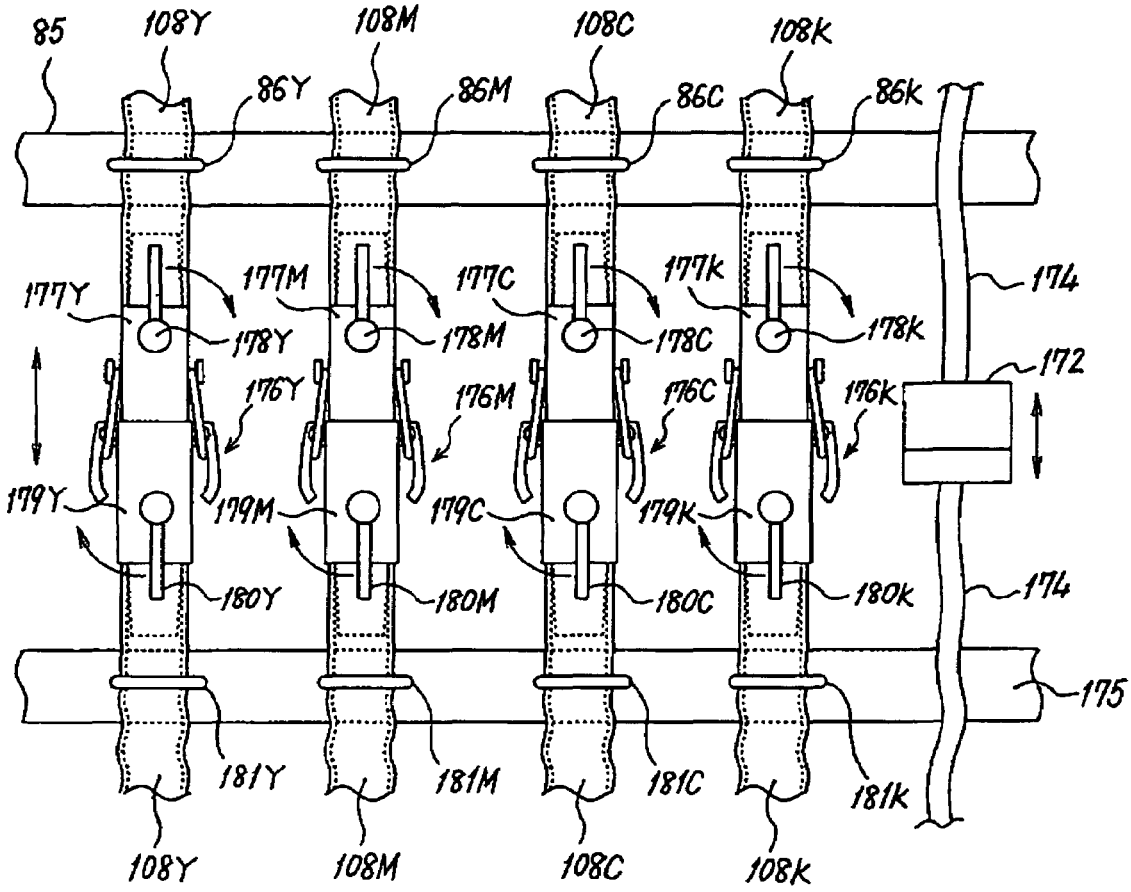
FIG. 8 is a plan view that shows from upper side the connecting portions between printer section and toner storage section of the exemplified printer shown in FIG. 2.
Figure 9:
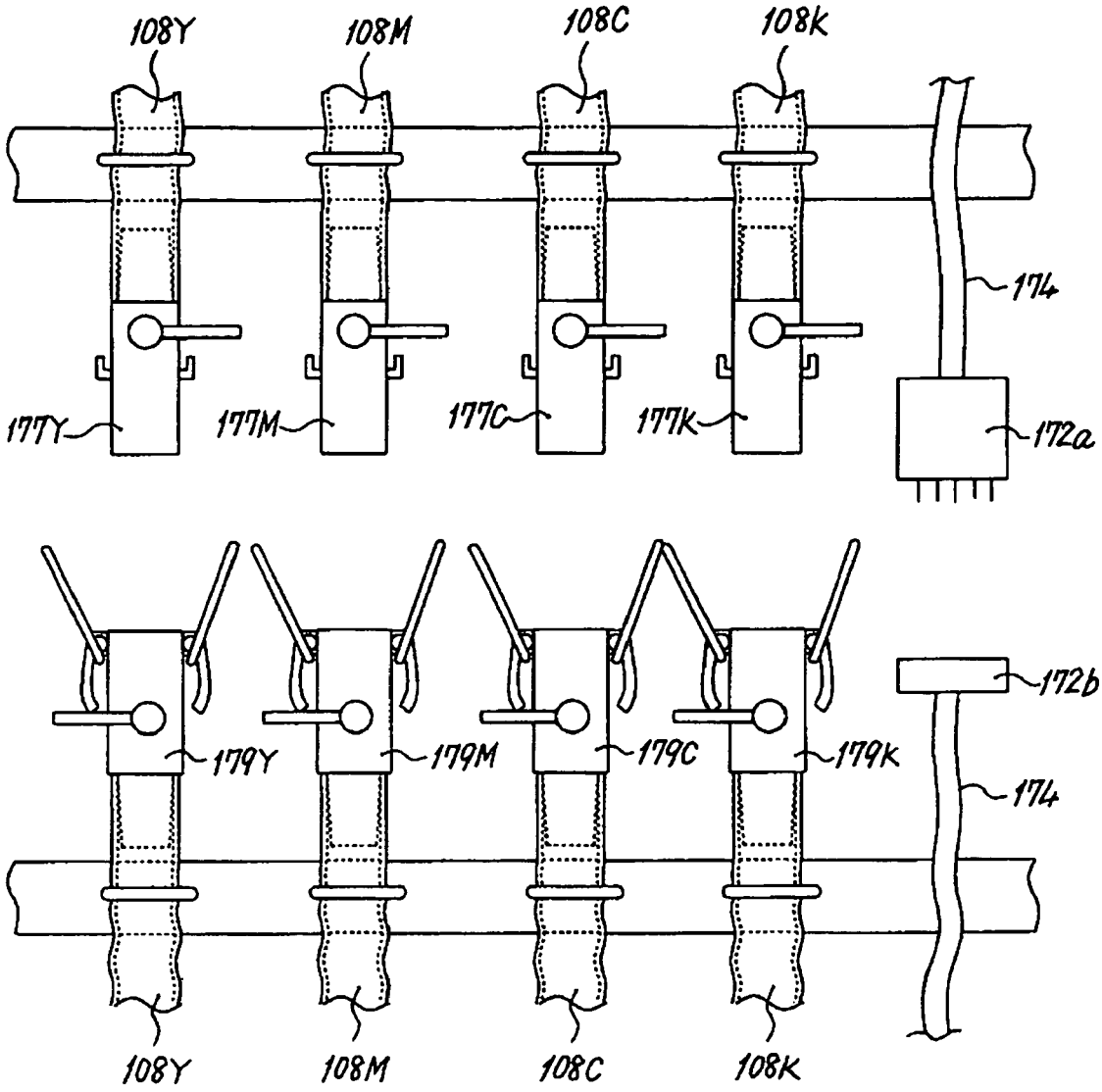
FIG. 9 is a plan view that shows from upper side the connecting portions in the separated condition between printer section and toner storage section of the exemplified printer.

FIG. 8 is a plan view that shows from upper site the connecting portions between printer section 90 and toner storage section 100 in the exemplified printer. Gas hoses 108Y, 108M, 108C, and 108K of four toner conveying devices are fixed to the bracket 85 supported by the housing (not shown) by means of U bolts 86Y, 86M, 86C, and 86K. Further, harness 174 is connected to the bracket 85 that electrically connects the toner supply control portion and electric device of the toner storage section. These gas hoses 108Y, 108M, 108C, and harness 174 are also connected to bracket supported by trestle of the toner storage section. Couplings with cocks 176Y, 176M, 176C, and 176K are provided for gas hoses 108Y, 108M, 108C, and 108K each at a position between the fixed site by bracket 85 of the printer section and the fixed site by bracket of the toner storage section. The couplings with cocks 176Y, 176M, 176C, and 176K respectively comprise male couplings 177Y, 177M, 177C, and 177K respectively equipped with cocks 178Y, 178M, 178C, and 178K for shutting the line, and female couplings 179Y, 179M, 179C, and 179K respectively equipped with cocks 180Y, 180M, 180C, and 180K. The respective engagements of these male couplings and female couplings may connect detachably two parts of conveying hoses 108Y, 108M, 108C, and 108K for printer section 90 and toner storage section 100.

The harness 172 is equipped with connector 172 between the site fixed with bracket 85 of printer section and the site fixed with bracket 175 of toner storage section, and is detachable for printer side and toner storage side at the connector 172.

When the printer section and the toner storage section are separated, the respective cocks 178Y, 178M, 178C, and 178K of male couplings 177Y, 177M, 177C, and 177K and respective cocks 180Y, 180M, 180C, and 180K of female couplings 179Y, 179M, 179C, and 179K are rotated 90 degrees clockwise, thereby each toner flow is stopped in the conveying hoses 108Y, 108M, 108C, and 108K. Then the engagements are released between the male couplings 177Y, 177M, 177C, and 177K and female couplings 179Y, 179M, 179C, and 179K. Then harness 172 is separated at the connector followed by moving the toner storage section by use of the caster, thus the printer section and the toner storage section are easily separated.

The printer section 90 and the toner storage section 100 are supported by the different support or trestle and also are easily separable into two parts in the exemplified printer; thus these can be subjected to maintenance independently.

Further, four suction pumps are supported by the frame or trestle (not shown) of the printer section in the exemplified printer, thereby four suction pumps can be disposed near the toner storage section at the discharge side, which enables sucking conveyance of toner rather than discharging conveyance along almost entire distance of the toner conveying line. In is well-known that suction pumps exhibit considerably higher conveying capacity in sucking conveyance rather than in discharging conveyance; therefore, sucking conveyance along almost entire distance of the toner conveying line may enhance the pump capacity efficiently.

In the exemplified printer, four casters 152 are provided to support or trestle 151 as shown in FIG. 2, which allows to move the toner storage section 100. Therefore, an operator can easily carry the toner storage section 100 manually after separating from printer section 90. Further, since each of the toner storage portions of image recording portions is the site to which toner is conveyed by each of the toner conveying devices, some amount of toner can be stored within printer section 90 in addition to toner storage section 100. This some amount of toner within printer section 90 and easy separation of printer section 90 from toner storage section 100 enable to utilize one toner storage section for plural printer sections.

In the above discussions, although the present invention is explained as to the exemplified printer that is one of electrophotographic image forming apparatuses, the present invention may be applied for other image forming apparatuses such as image forming apparatuses based on direct recording as those illustrated in JP-A No. 2000-238311. When the present invention is employed to such direct recording, the toner applying device performs as the image forming unit and the related toner storage portion is the site to which toner is supplied.

The following advantages may be obtained by use of the exemplified printer, conclusively.

Nozzle 164 is disposed at the bottom zone of toner containing portion 154 and porous member 167 is disposed at the taper zone adjacent to the bottom; therefore, only the fluidized toner can be fed into nozzle 164 and conveying pipe 108.

Further, nozzle 164 is equipped with porous tube 166 on the line, and air is fed into the porous tube 166; therefore, toner fluidization is promoted not only within toner containing portion but also within nozzle 164, thus clogging can be suppressed more surely in the conveying line.

Further, suction pump 101 acts to discharge toner toward toner storage portion 27 of developing device 20 while sucking the toner within conveying pipe 108; therefore, toner can be conveyed from lower site to higher site of toner storage portion 27.

Further, the conveying pipe is flexible; therefore, the margin to design the layout can be expanded significantly in the printer section 90.

Further, the toner supply control part is provided to control suction pump 101 to be actuated intermittently; therefore, the feed rate may be controlled delicately even when the suction pump can provide relatively high feed rate per unit period.

Further, lower level sensor 170 is provided in toner containing portion 154 and suction pump 101 is controlled thereby, suction pump 101 does not work when toner containing portion is empty.

Further, gas duct 160 is provided in toner containing portion 154 to evacuate the container zone 155; therefore, the air fed into toner containing portion 154 cannot excessively raise the pressure in toner containing portion 154.

Further, gate valve 162 is provided to control the flow rate of evacuated gas through gas duct 160; therefore, toner discharge can be promoted by pressurizing within toner containing portion 154 above normal pressure by controlling the flow rate; and also the toner can be conveyed to upper site without suction pump 101 as described above.

Further, upper limit sensor 169 to detect a certain upper limit in toner containing portion 154 and the related alarm are provided; therefore, erroneous manual processing may be effectively prevented such as overflow from toner containing portion 154.

Further, conveying pipe 108 can be separated detachably into two parts, and the two parts are supported separately. Therefore, toner storage section 100 can store, for example, relatively large amount of toner and supply to the respective image recording portions of printer section 90 depending on requirements, and also printer section 90 and toner storage section 100 can be easily separated and be subjected to maintenance independently.

Further, since the frame or trestle of printer section 90 supports suction pump 101, the efficiency to convey the toner may be enhanced for suction pump 101 owing to almost all of conveying pipe 108 is subjected to sucking.

Further, support or trestle 151 is movable owing to four caster 152; therefore, toner storage section 100 can be easily carried independently from printer section 90.

Further, toner storage portion 20 can store an amount of toner in printer section 90; therefore, plural printer sections 90 can share one toner storage section while being moved by casters 152.

Further, toner containing portion 154 is detachably attached to support or trestle 151; therefore, the cleaning and other maintenance of toner containing portion 154 can be conducted easily.

EXAMPLE 2

Figure 10:
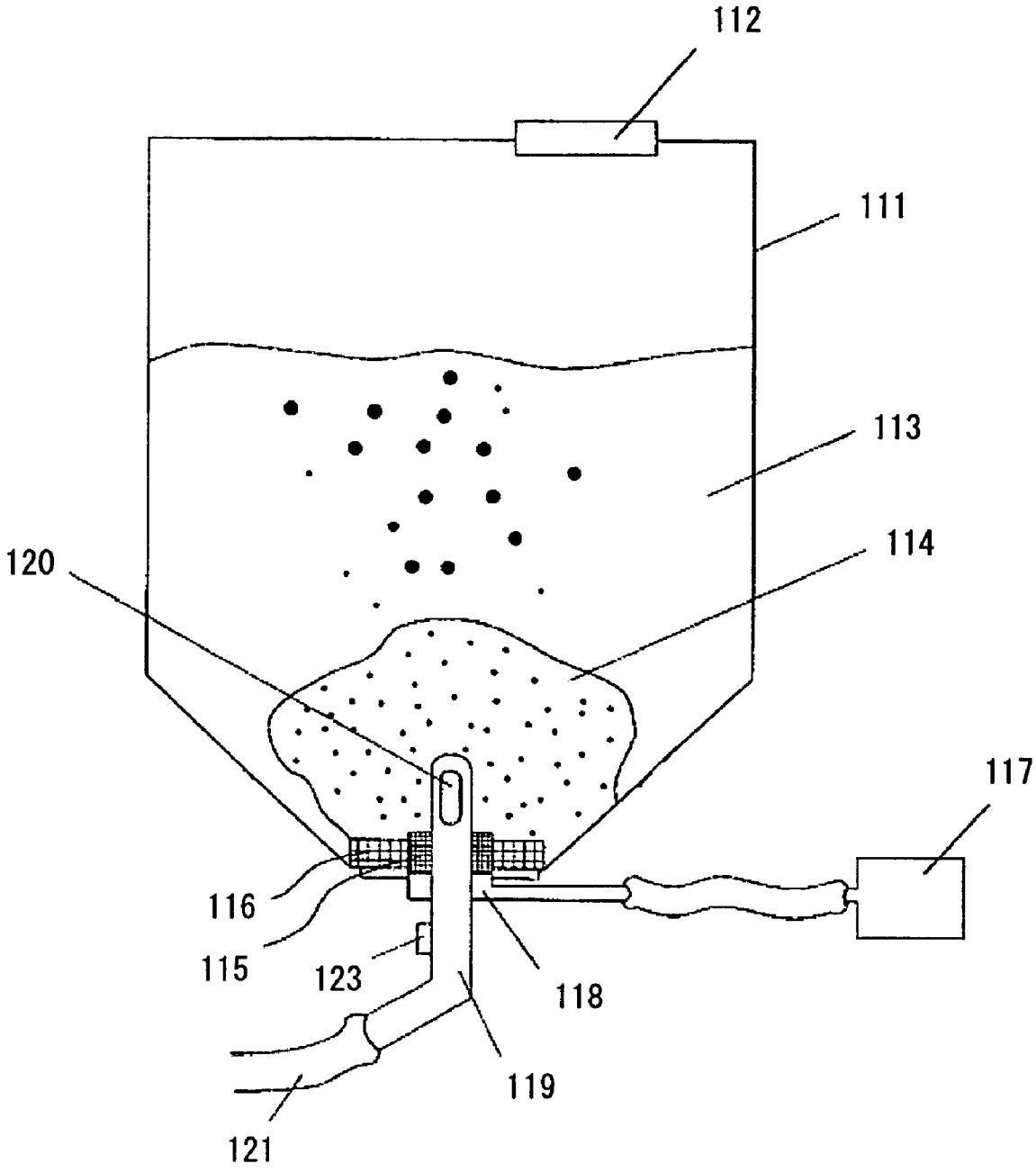
FIG. 10 is a schematic view that shows an exemplary construction of a toner supplying device according to the present invention.

Another toner conveying device and image forming apparatus will be explained that is equipped with the toner conveying device. FIG. 10 exemplarily shows a toner supplying device according to the present invention.

In FIG. 10, reference number 111 indicates a toner containing portion made of polyethylene resin to be attached to a copier. A plug 116 formed of elastic material is attached to the lower part of toner containing portion 111. Nozzle 119 is inserted into toner containing portion 111 through plug while maintaining sealed condition by action of the elastic material. Plug 116 is cut crosswise at the central portion into which nozzle 119 is inserted. At the tip end of nozzle 119, a mesh can be attached which act to reside the agglomerated toner till the agglomeration is broken. A porous sintered glass having an average pore size of 10 μm and a thickness of 5 mm, for example, is mounted to around nozzle 119 to form a gas ejecting device 115, which eject gas toward toner 113 within toner containing portion 111.

The gas ejecting device 115 ejects air into toner containing portion 111 from air pump 117 through gas duct 118 at a pressure of about 8 kPa and a feed rate of 100 to 300 ml/min, preferably 100 to 200 ml/min, for example, thereby to form fluidized bed 114 having a bulk density of 0.02 to 0.3 $g/cm^3$. The fluidized toner, containing air and having a high fluidity, is fed to a developing unit of an image forming apparatus (not shown) from outlet 120, having an aperture size of 5 mm, at tip end of nozzle 119 through toner conveying pipe 121.

The fluidized toner can be fed into the developing unit by the suction mechanism described above or by use of pressurized condition formed in toner containing portion 111 without the suction mechanism.

Figure 11:
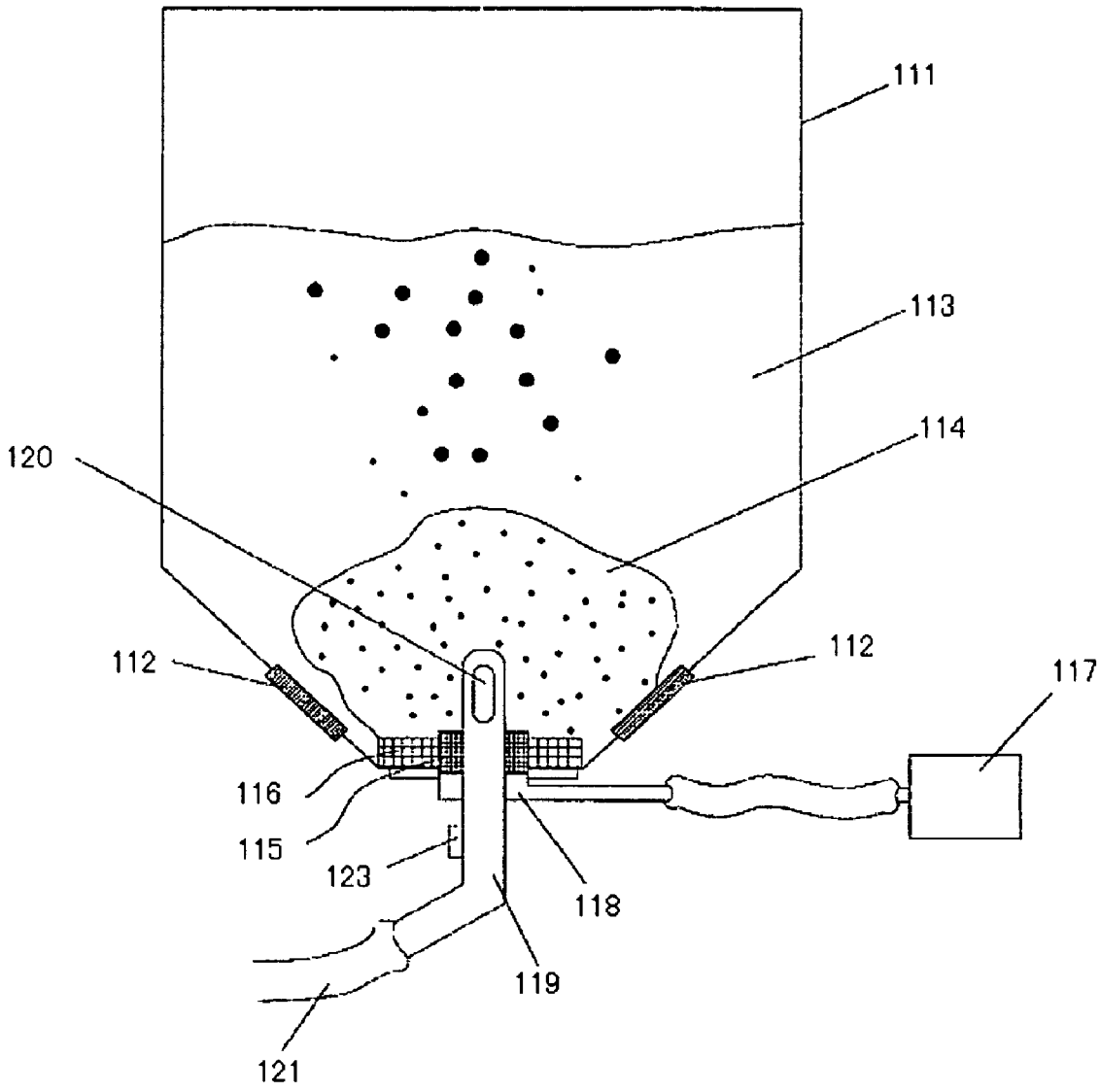
FIG. 11 is another schematic view that shows an exemplary construction of a toner supplying device according to the present invention.

In order to prevent excessively raised pressure due to feeding air into toner containing portion 111, filter 112 may be installed at upper wall of the toner containing portion 111, for example as shown in FIG. 10. The filter 112 act to pass air and filter the toner; appropriate material of the filter is polytetrafluoroethylene sheet (e.g. Gore-tex, by W.L. Gore & Associates, Inc.), for example. Also, the filter 112 may be disposed at taper portion as shown in FIG. 11.

Figure 12:
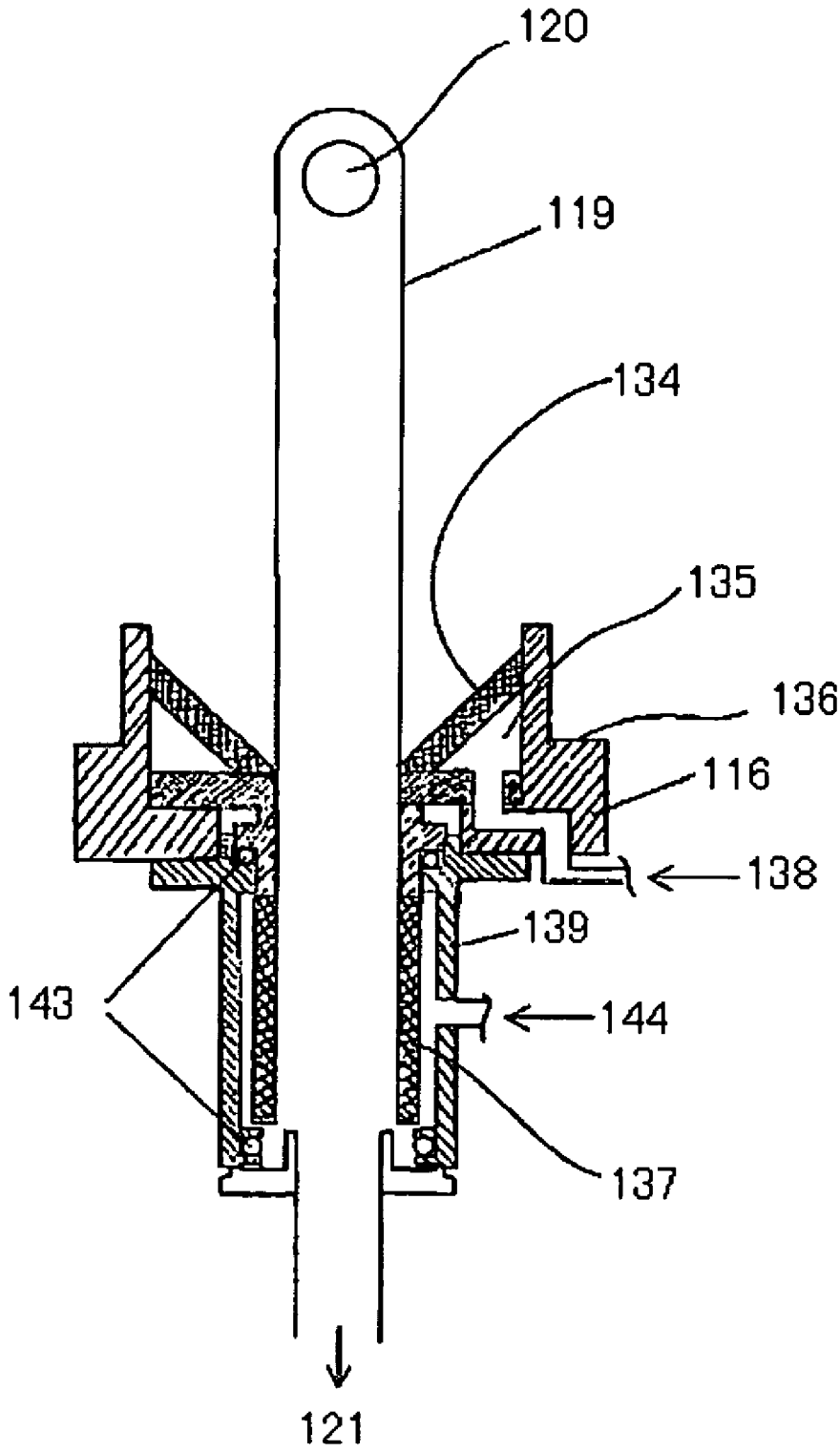
FIG. 12 is still another schematic view that shows an exemplary construction of a toner supplying device according to the present invention.

FIG. 12 exemplarily shows another gas ejecting device adapted to the present invention. Two air outlets are provided to the gas ejecting device in order to efficiently form fluidized zone 114 having higher fluidity in toner containing portion 111. The nozzle 119 is detachable from toner containing portion 111 and the height of nozzle is adjustable in the toner containing portion 111. Namely, the gas ejecting device comprises the first air outlet 134 that is equipped with a ring-like pressurized room 135 inside the flange 136 and the second air inlet of pipe-like shape under the flange 136. In this example, the first air outlet 134 exists above the plug 116, and the second air outlet exists 137 below the plug 136. These air outlets may be detachable or non-detachable from the plug 136. The pressurized room 135 is equipped with gas inlet 138; and the second gas outlet 137 is equipped with pipe-like casing 139 to which a gas inlet is provided. Reference number 143 in FIG. 12 is an O-ring.

Figure 13:
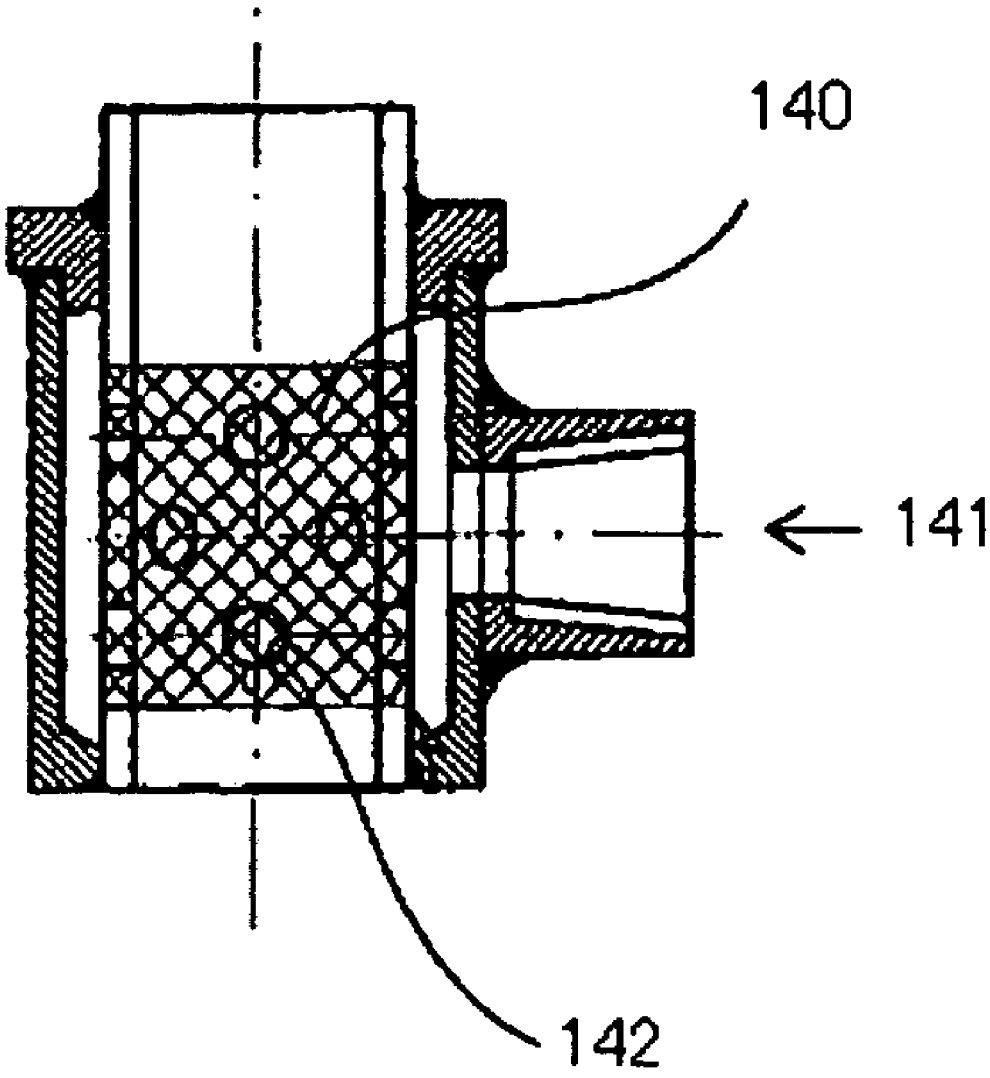
FIG. 13 is still another schematic view that shows an exemplary construction of a toner supplying device according to the present invention.

FIG. 13 exemplarily shows still another gas ejecting device adapted to the present invention. In this gas ejecting device, the second gas outlet is formed of mesh material rather than porous sintered metal. Specifically, the second gas outlet is formed by winding metal mesh 140 to form multi layered mesh around a pipe with plural through holes. Reference number 141 in FIG. 13 is a gas inlet.

Toner concentration sensor 123 may be provided, for example, below nozzle 119 of the toner supplying device according to the present invention as shown in FIG. 10. The toner concentration sensor 123 determines the toner concentration in the fluidized mixture of toner and air at toner conveying line, for example. The toner concentration may be utilized to grasp the proper condition of fluidized bed, abnormality such as clogging, or the like.

EXAMPLE 3

Toner containing portion may be vibrated in order to assure the performance of toner supplying device according to the present invention, as explained in the following.

Figure 14:
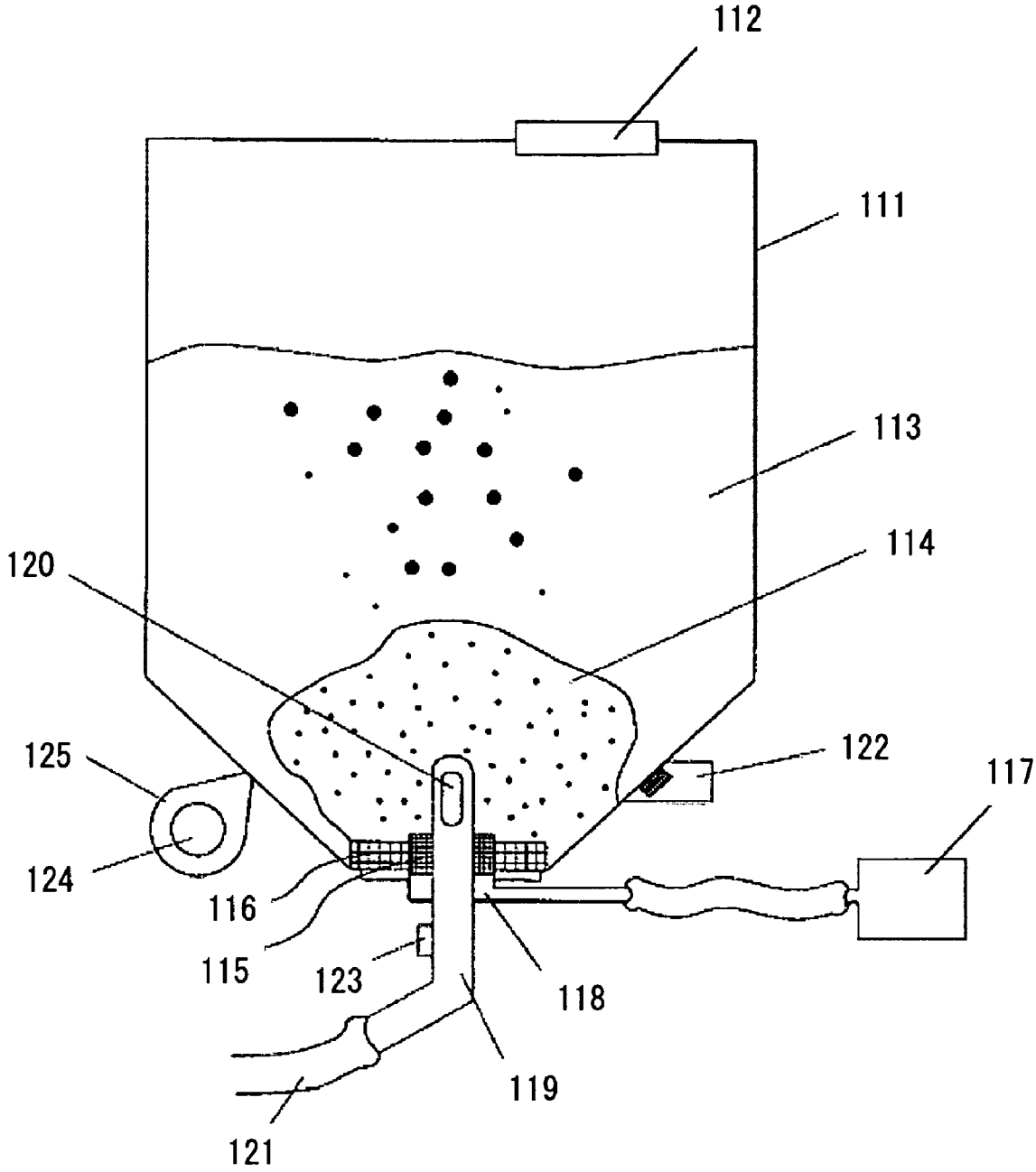
FIG. 14 is still another schematic view that shows an exemplary construction of a toner supplying device according to the present invention.

The inventive toner supplying device shown in FIG. 14 further comprises a vibrating device 122 on the outer surface of the toner containing portion and near the nozzle 120 in order to improve the formation of fluidized bed. The toner supplying device shown in FIG. 14 is substantially the same as that shown in FIG. 10, except for adding the vibrating device 122. The same reference numbers in FIG. 14 indicate the same objects with those of FIG. 10.

The vibrating device 122 may be a sonic vibrator that contacts with outer surface of the container containing a toner when the toner is supplied to the image forming apparatus. Alternatively, the vibrating device 122 may be a hammer vibrator which contacts with outer surface of the container containing a toner when the toner is supplied to the image forming apparatus. Further, the vibrating device 122 may be an eccentric cam 125 that knocks toner containing portion 111 at a projection fixed to the shaft 124 by rotating the shaft 124 as shown in FIG. 14. Further, plural eccentric cams may be provided and the vibration may be generated at a frequency higher than the rotating frequency of the shaft.

The vibrating device 122 may be activated before the gas feeding unit is activated; and may be stopped before the gas feeding unit is stopped. As such, the vibrating device 122 is preferably operated independently from the gas feeding unit.

When the vibrating device 122 is of a sonic vibrator, the vibration energy is 80 to 120 dB, and the frequency is lower range of 1 Hz to 20 kHz or still higher range, for example. In order to break toner blocks or agglomerates and promote the fluidity, the frequency is preferably 1 to 7000 Hz, more preferably 5 to 5000 Hz. When the sonic vibrator is complementally utilized for merely enhancing the fluidity, the frequency is preferably 20 to 300 Hz. Preferably, the sonic vibrator is covered by sound barrier or acoustic material in order to reduce the noise.

Preferably, the vibrating device is disposed at tapered portion of the converging zone of the toner containing portion in order to break toner blocks and to promote the fluidity. Preferably, the toner containing portion have a thinner wall thickness at the area where the vibrating device contacts with than the other area, thereby the vibration is effectively propagated.

The toner supplying device in Example 3 is equipped with a piezoelectric vibrator (Type FE-27A-41A, by FDK Co.) as vibrating device 122 having a main frequency range of 3600 to 4600 Hz and a sound pressure of 65 to 90 dB.

From an experiment as to the effect of vibrating devices, when vibrating device 122 is operated for two minutes immediately before the gas feed unit is operated, the operating period was shortened about 20% that was necessary for decreasing the bulk density into 0.3 g/cm$^3$.

The operating period of the vibrating device is optionally determined, for example, within an intermittent range of 10 seconds to 20 minutes; the vibrating device may be operated from several minutes before the gas feeding unit is operated; and the vibrating device may be operated repeatedly for several seconds after the gas feeding unit is operated.

The gas feeding unit in Example 3 is formed from a porous material through which air passes. The average pore size of the porous material is preferably about 12 μm since the particle size of the toner is 3 to 15 μm and the volume average particle size is about 12 μm. The porous material may be selected from resins, sintered metals, and multi layered mesh.

The gas feeding unit is activated, for example, when a main switch of a copier is turned on, then may be activated intermittently depending on the consumed amount of the toner. The vibrating device described above may be activated by the signal from the gas feeding unit or may be activated prior to the gas feeding unit and may be stopped before the gas feeding unit. Further, by means of adjusting the start and stop timings of a mono pump and gas feeding unit 115, toner conveying amount may be adjusted, the mixture of the toner and the gas may be controlled as to the bulk density, and the removal of external additives may be prevented from toner.

Figure 15:
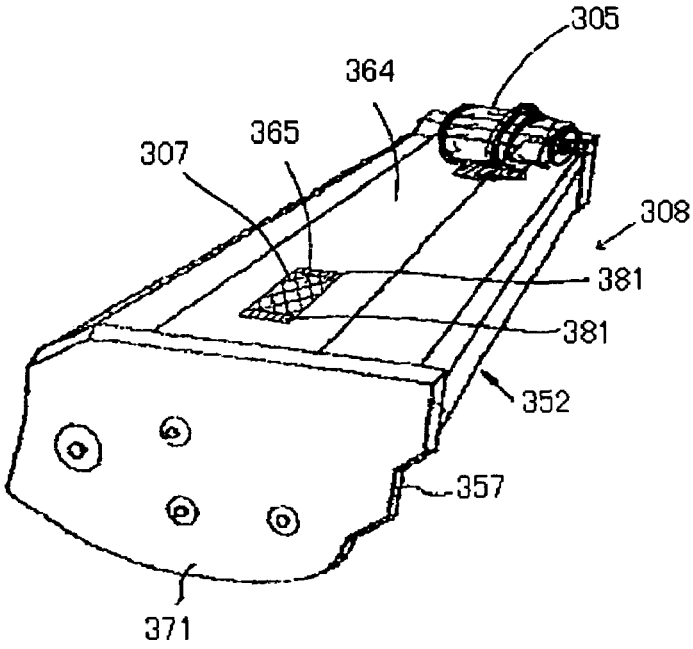
FIG. 15 is a schematic perspective view that shows an exemplary construction of an image forming apparatus to which the inventive toner supplying device is connectable.
Figure 16:
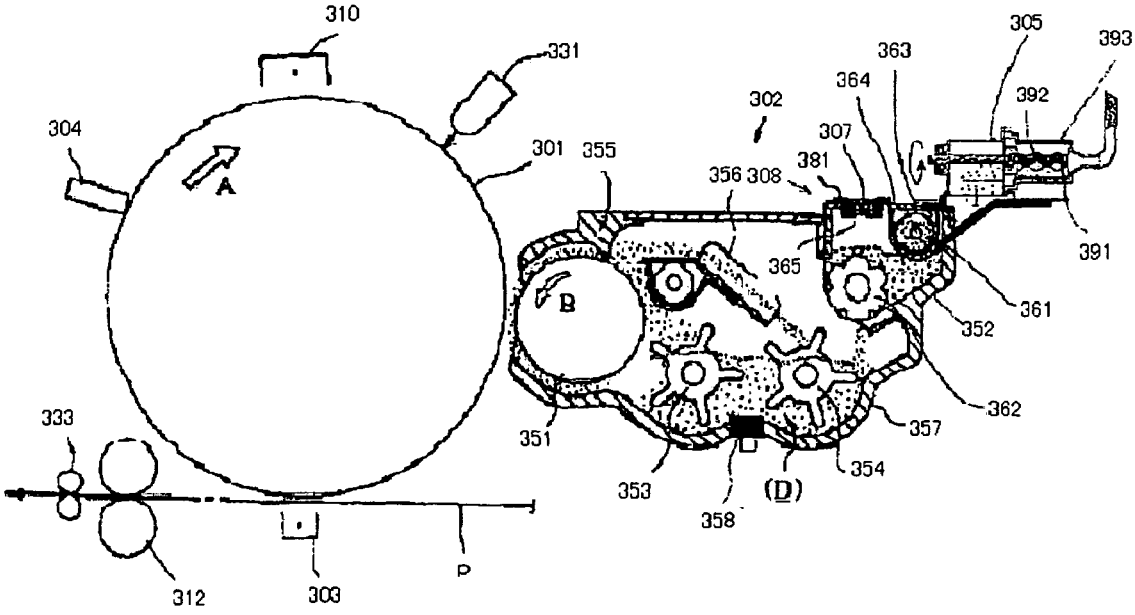
FIG. 16 is a schematic cross section that shows an exemplary construction of an image forming apparatus to which the inventive toner supplying device is connectable.

FIG. 15 is a an exemplary construction of an image forming apparatus to which the inventive toner supplying device is connectable, and FIG. 16 is a schematic cross section of an image forming apparatus to which the inventive toner supplying device is connectable.

In FIGS. 15 and 16, electrostatic latent image bearing member 301 of an image forming apparatus is disposed rotatably and rotated clockwise in FIG. 16 in the direction A.

The electrostatic latent image bearing member 301 is charged by charging unit 310 and an electrostatic latent image is formed by irradiating unit 331. The electrostatic latent image is visualized by means of a toner of developer D supplied from developing unit 302 to form a toner image. The image bearing member may be of a belt instead of a drum. The toner image formed on electrostatic latent image bearing member 301 is transferred on a transferring member P by transferring unit 303, fixed at fixing unit, and discharged by discharging roller 333, then the transferring member P is collected in a discharged paper tray. Cleaning unit 304 cleans the residual toner deposited on electrostatic latent image bearing member 301 after the toner image is transferred, thus the next image forming is ready.

Developing unit 302 is constructed from developing sleeve 351 that feeds developer D onto electrostatic latent image bearing member 301, developer supplying portion 352, developer stirring units 353 and 354, developer layer control member 355, conveying uni5 356, toner concentration sensor 358 to detect the developer concentration, and housing 357. The developing sleeve 351 is disposed oppositely to the drum surface of the electrostatic latent image bearing member 301. The developing unit 302 is equipped with an evacuating unit (not shown) to prevent the developer D from dispersing through the gap between developing sleeve 351 and housing 357. The developing sleeve 351 is constructed from a non-magnetic sleeve and a magnet disposed inside the sleeve, and is rotated in the direction B anticlockwise in FIG. 16. The size of developing sleeve 351 in the width direction is approximately the same with that of the electrostatic latent image bearing member 301.

The developer supplying portion 352 is constructed from developer conveying screw 361 and developer feeding puddle 362 having grooves on the surface. The developer supplying portion 352 supplies the developer D, which is a fluidic powder i.e. mixture of toner and gas sent from the toner supplying device according to the present invention, into developing unit 302 through conveying unit 305.

The developer supplying portion 352 is equipped with developer inlet 363, as shown in FIG. 16. The developer inlet 363 connects the flow line between the toner supplying device and conveying unit 305.

The developer D fed into developer inlet 363 is fed to one axial end of screw 361. To the developer supplying portion 352, vent hole 365 is formed at upper plate 364 as shown in FIG. 16, air filter 307 is provided to the vent hole 365. The air filter 307 passes through and separates the developer from the air, and is fixed detachably by nail 381.

The conveying unit 305 may be a screw pump, e.g. mono pump, which is one of powder pump unit, and is constructed from screw-shape rotor 391, stator 392, pump holder 393 and the like.

The rotor 391 is connected to a motor (not shown). The stator 392 formed of elastic material such as rubber is provided around the rotor 391. Passage is formed within stator 392 such that the mixture of toner and gas is fed while rotor 391 rotating. Pump holder 393 holds stator 392. The pump holder 393 is cylindrical, and connects between the conveying unit 305 and the toner conveying line.

Figure 17:
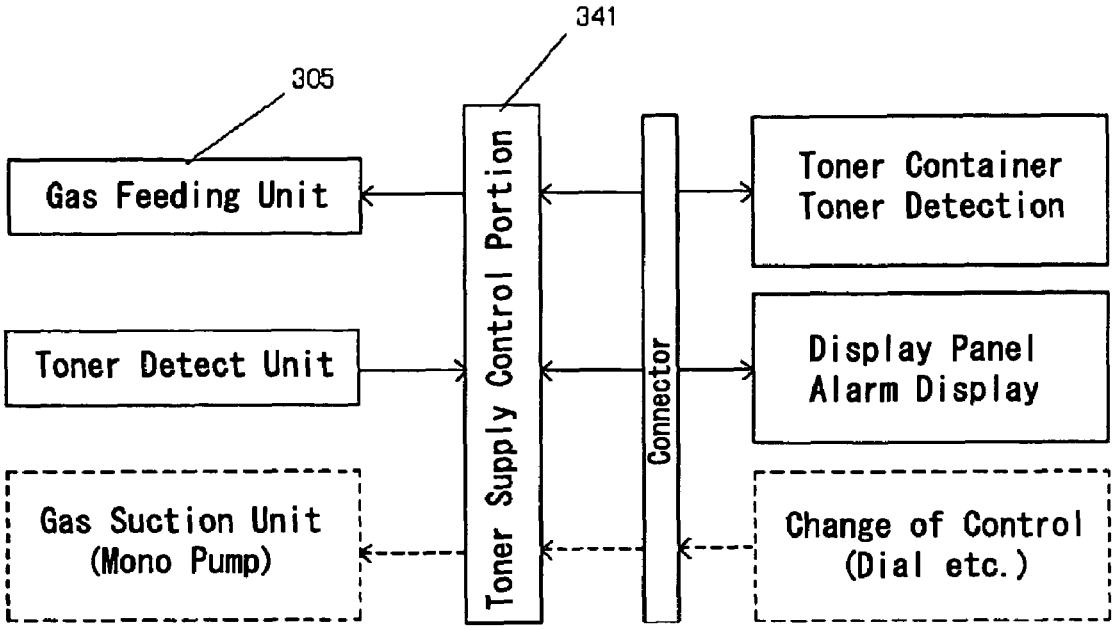
FIG. 17 is a block diagram that shows a part of electrical circuit of an image forming apparatus to which the inventive toner supplying device is connectable.

FIG. 17 is a schematic block diagram that shows a part of control circuit of the image forming apparatus that is equipped with the toner conveying device according to the present invention. Toner supply control portion 341, which is also utilized for the toner conveying device according to the present invention, is disposed in addition to gas pump 305 within the image forming apparatus.

To the toner supply control portion 341, gas pump 305, toner concentration sensor 358 at developing unit 302, and toner concentration sensor 123 at nozzle 119 are electrically connected.

The toner supply control portion 341 acts to fluidize the toner within toner container 111 by activating pump 117 in FIG. 10, when the main switch (not shown) of the image forming apparatus is on state unless any accident is not recognized. Further, the supply control portion 341 acts to supply toner by activating gas pump 305 depending on toner concentration sensor 358. Specifically, when the toner concentration sensor 358 shown in FIG. 16 detects that the toner within the containing portion is lower than the predetermined level, the supply control portion 341 acts to drive the pump 117 for a standard period. The standard period is determined to be sufficiently long for the toner concentration sensor 358 to detect the toner again. Accordingly, when pump 117 stops after the standard period, the toner concentration sensor 358 can usually detect the toner.

On the other hand, when toner concentration sensor 123 below nozzle 119 as shown in FIG. 10 detects that the toner amount is lower than the predetermined level, an alarm is generated to replace the toner container.

The toner supplying devices, toner supplying processes, image forming apparatuses, and image forming processes according to the present invention can control the bulk density of the mixture of toner and gas more efficiently, thereby the fluidity of the mixture is enhanced, and the fluidity may be maintained uniformly within toner conveying lines even when the toner resides for a long period, therefore, can be appropriately employed in printers, facsimiles, copiers, and electrophotographic image forming apparatuses and processes.

Although the present invention has been described in detail with reference to certain aspects and examples for the purpose of illustration, it is to be understood that variations and modifications can be made by those skilled in the art without departing from the spirit and scope of the invention.

What is claimed is:

1. A toner supplying device comprising:

a toner containing portion configured to store a toner;

a nozzle having a toner outlet configured for discharge of the toner from the toner containing portion;

a conveying pipe configured to connect to the nozzle for supplying the toner from the toner containing portion to an image forming unit;

a porous member disposed at the nozzle; and a gas feeding unit configured to feed a gas into the nozzle through the porous member.

2. The toner supplying device according to claim 1, further comprising an additional porous member, wherein the toner containing portion comprises a converging zone where a side wall gradually tapers toward the toner outlet, wherein the additional porous member is disposed on the side wall in the converging zone, and wherein the gas feeding unit is configured to feed a gas into the toner containing portion through the additional porous member.

3. The toner supplying device according to claim 2, wherein one of a traverse cross section, a width, and a diameter of the side wall gradually decreases toward the toner outlet at the converging zone.

4. The toner supplying device according to claim 2, wherein the toner containing portion is a toner container equipped with the toner outlet, and wherein the additional porous member is disposed adjacent to the toner outlet of the toner container.

5. The toner supplying device according to claim 2, further comprising a gas outlet is provided on the toner containing portion, wherein a filter is provided within the gas outlet, and wherein said filter is configured to allow discharge of gas from within the toner containing portion and to prevent discharge of the toner.

6. The toner supplying device according to claim 1, wherein the porous member has pores configured to allow gas to pass therethrough, and where an average size of the pores is configured to be 0.1 times to 5 times a volume average particle size of the toner.

7. The toner supplying device according to claim 1, wherein an average pore size of the porous member is 0.3 μm to 20 μm.

8. The toner supplying device according to claim 1, wherein the toner containing portion is a toner container equipped with the toner outlet.

9. The toner supplying device according to claim 1, wherein a vibrating device is provided which is configured to vibrate the toner within the toner containing portion.

10. The toner supplying device according to claim 9, wherein the vibrating device is a sonic vibrator that contacts with an outer surface of the toner containing portion.

11. The toner supplying device according to claim 9, wherein the vibrating device is a hammer vibrator that contacts with an outer surface of the toner containing portion.

12. The toner supplying device according to claim 9, wherein the vibrating device is a unit configured to repeatedly contact with an outer surface of the toner containing portion to vibrate the toner containing portion.

13. The toner supplying device according to claim 9, wherein the vibrating device is configured to activate after the toner containing portion is mounted to the image forming apparatus.

14. The toner supplying device according to claim 9, wherein the vibrating device is disposed at a tapered portion of the toner containing portion.

15. The toner supplying device according to claim 1, wherein the nozzle is attached to a cap member that is configured to be detachably connected to the toner containing portion, wherein the toner outlet comprises a hole on an end of the nozzle that extends inside the toner containing portion when the cap member is connected to the toner containing portion, and wherein the porous member is provided on another end of the nozzle that extends outside the toner containing portion when the cap member is connected to the toner containing portion.

16. The toner supplying device according to claim 1, wherein a toner concentration sensor is provided near adjacent to the toner outlet.

17. The toner supplying device according to claim 1, wherein the conveying pipe is configured to connect to a developing device for supplying the toner in the toner containing portion to the developing device which develops a latent image formed on an electrostatic latent image bearing member.

18. The toner supplying device according to claim 1, wherein the toner outlet comprises a hole on an end of the nozzle that extends inside the toner containing portion.

19. The toner supplying device according to claim 1, wherein the porous member is provided adjacent the conveying pipe.

20. The toner supplying device according to claim 1, wherein the conveying pipe is a flexible conveying hose.

21. The toner supplying device according to claim 1, wherein a sucking unit is provided which is configured to feed toner into an image forming apparatus while sucking the toner existing within the conveying pipe.

22. The toner supplying device according to claim 21, wherein a sucking control unit is provided which is configured to control the action of the sucking unit, and the sucking unit is configured to be activated intermittently.

23. The toner supplying device according to claim 22, wherein a lower limit detector is provided that is configured to detect a lower level of toner in the toner containing portion, and the sucking control unit controls the sucking unit depending on the lower limit detector.

24. The toner supplying device according to claim 1, wherein an evacuating unit is provided which is configured to evacuate the gas within the toner containing portion.

25. The toner supplying device according to claim 24, wherein an evacuation control unit is provided which is configured to control an evacuating rate of the evacuating unit.

26. The toner supplying device according to claim 1, wherein an upper limit detector is provided which is configured to detect a predetermined upper level of toner in the toner containing portion, and an alarm generator is provided which is configured to generate an alarm depending on the upper limit detector.

27. A toner supplying device comprising:

a toner containing portion configured to store a toner;

a toner outlet configured for discharge of the toner from the toner containing portion;

a conveying pipe configured to connect to the toner outlet for supplying the toner from the toner containing portion to an image forming unit;

a porous member disposed near the toner outlet; and a gas feeding unit configured to feed a gas into the toner containing portion through the porous member, wherein a vibrating device is provided which is configured to vibrate the toner within the toner containing portion, and wherein the vibrating device is configured to activate prior to activating the gas feeding unit.

28. A toner supplying device comprising:

a toner containing portion configured to store a toner;

a toner outlet configured for discharge of the toner from the toner containing portion;

a conveying pipe configured to connect to the toner outlet for supplying the toner from the toner containing portion to an image forming unit;

a porous member disposed near the toner outlet; and a gas feeding unit configured to feed a gas into the toner containing portion through the porous member, wherein a vibrating device is provided which is configured to vibrate the toner within the toner containing portion, and wherein the toner containing portion has a thinner wall thickness at an area where the vibrating device contacts with the toner containing portion than a wall thickness at another area of the toner containing portion.

29. A toner supplying process comprising:

flowing toner from a toner containing portion into a nozzle having a toner outlet for discharging the toner from the toner containing portion into a conveying pipe;

feeding a gas through a porous member disposed at the nozzle; and conveying the toner through the conveying pipe, wherein the toner is conveyed from the toner containing portion to an image forming unit of an image forming apparatus.

30. The process for conveying a toner according to claim 29, wherein a vibrating device is provided which is configured to vibrate the toner within the toner containing portion.

31. An image forming apparatus comprising:

an electrostatic latent image bearing member, an electrostatic latent image forming unit configured to form an electrostatic latent image on the electrostatic latent image bearing member, an image forming unit configured to develop a toner image by means of a toner, a toner supplying unit configured to supply the toner, a transferring unit configured to transfer the toner image onto a recording medium, and a fixing unit configured to fix the transferred image on the recording medium, wherein the toner supplying unit comprises a toner containing portion configured to store a toner, a nozzle having a toner outlet configured for discharge of the toner from the toner containing portion, a conveying pipe configured to connect to the nozzle for supplying the toner from the toner containing portion to the image forming unit, a porous member disposed at the nozzle, and a gas feeding unit configured to feed a gas into the nozzle through the porous member.

32. The image forming apparatus according to claim 31, wherein the toner supplying unit is disposed inside the image forming apparatus.

33. The image forming apparatus according to claim 31, wherein the toner supplying unit is disposed outside the image forming apparatus.

34. The image forming apparatus according to claim 31, wherein an open-close shutter is provided at a toner receiving inlet of the image forming unit which is configured to receive the toner conveyed by the toner supplying unit.

35. The image forming apparatus according to claim 31, wherein the conveying pipe is reversibly separable into two pipes, and one pipe is supported by a first support which also supports the image forming unit, the other pipe is supported by a second support which also supports the toner containing portion and the gas feeding unit.

36. The image forming apparatus according to claim 35, wherein the toner containing portion is detachably attached to the second support.

37. The image forming apparatus according to claim 31, wherein the toner supplying unit is movable by means of at least a caster.

38. The image forming apparatus according to claim 31, wherein the toner is sent from the toner conveying unit to a toner storage section within the image forming unit where the toner is stored temporarily.

39. An image forming apparatus comprising:

an electrostatic latent image bearing member, an electrostatic latent image forming unit configured to form an electrostatic latent image on the electrostatic latent image bearing member, an image forming unit configured to develop a toner image by means of a toner, a toner supplying unit configured to supply the toner, a transferring unit configured to transfer the toner image onto a recording medium, and a fixing unit configured to fix the transferred image on the recording medium, wherein the toner supplying unit comprises a toner containing portion configured to store a toner, a toner outlet configured for discharge of the toner from the toner containing portion, a conveying pipe configured to connect to the toner outlet for supplying the toner from the toner containing portion to the image forming unit, a porous member disposed near the toner outlet, and a gas feeding unit configured to feed a gas into the toner containing portion through the porous member, wherein the conveying pipe is reversibly separable into two pipes, and one pipe is supported by a first support which also supports the image forming unit, the other pipe is supported by a second support which also supports the toner containing portion and the gas feeding unit, and wherein a sucking unit is supported by the first support.

40. An image forming process comprising:

forming an electrostatic latent image on an electrostatic latent image bearing member, developing a toner image by means of a toner, supplying the toner for developing the toner image from a toner containing portion, transferring the toner image onto a recording medium, and fixing the transferred image on the recording medium, wherein the supplying of the toner comprises:

flowing the toner from the toner containing portion configured to store the toner into a nozzle having a toner outlet for discharging the toner from the toner containing portion into a conveying pipe;

feeding a gas through a porous member disposed at the nozzle; and conveying the toner through the conveying pipe, wherein the toner is supplied from the toner containing portion to an image forming unit of an image forming apparatus.

* * * * *